US008356822B2

(12) United States Patent
McLeod et al.

(10) Patent No.: US 8,356,822 B2
(45) Date of Patent: Jan. 22, 2013

(54) SNOWBOARD

(75) Inventors: Ian McLeod, Costa Mesa, CA (US); Pat McLeod, Costa Mesa, CA (US)

(73) Assignee: Auto Deck Snowboards LLC, Mission Viejo, CA (US)

( * ) Notice: Subject to any disclaimer, the term of this patent is extended or adjusted under 35 U.S.C. 154(b) by 0 days.

(21) Appl. No.: 13/289,910

(22) Filed: Nov. 4, 2011

(65) Prior Publication Data

US 2012/0061929 A1 Mar. 15, 2012

Related U.S. Application Data

(63) Continuation of application No. 12/852,293, filed on Aug. 6, 2010, now abandoned.

(60) Provisional application No. 61/232,311, filed on Aug. 7, 2009.

(51) Int. Cl.
*A63C 5/044* (2006.01)

(52) U.S. Cl. ..... 280/14.22; 280/609; 280/28

(58) Field of Classification Search ..... 280/28, 280/609, 14.22
See application file for complete search history.

(56) References Cited

U.S. PATENT DOCUMENTS

| | | | | |
|---|---|---|---|---|
| 2,531,946 | A | 11/1950 | Parker | |
| 3,374,003 | A * | 3/1968 | Fulsom | 280/18 |
| 3,378,274 | A * | 4/1968 | Poppen | 280/18 |
| 3,534,972 | A | 10/1970 | Salerno | |
| 3,655,211 | A | 4/1972 | Bollettieri et al. | |
| 3,827,096 | A | 8/1974 | Brownson | |
| 3,907,315 | A | 9/1975 | Charneck | |
| 3,918,114 | A | 11/1975 | Schmitt | |
| 4,147,377 | A | 4/1979 | Plenk | |
| D257,052 | S * | 9/1980 | Schrishuhn, Jr. | D21/766 |
| 4,262,925 | A | 4/1981 | Plenk | |
| 4,561,664 | A * | 12/1985 | Cashmere | 280/18 |
| 5,135,249 | A | 8/1992 | Morris | |
| 5,868,405 | A * | 2/1999 | Lavecchia et al. | 280/14.21 |
| 6,086,101 | A * | 7/2000 | Cormican | 280/809 |
| 6,105,979 | A * | 8/2000 | Desrochers | 280/28 |
| 6,189,912 | B1 | 2/2001 | Ritzinger | |
| 6,290,249 | B1 * | 9/2001 | Wolf | 280/609 |
| 6,357,781 | B1 * | 3/2002 | Jeandin | 280/609 |

(Continued)

FOREIGN PATENT DOCUMENTS

| | | | |
|---|---|---|---|
| JP | 03055995 | U9 | 11/1998 |
| KR | 20-0155140 | Y1 | 8/1999 |

(Continued)

OTHER PUBLICATIONS

PCT International Search Report and Written Opinion, PCT/US2010/044775, Aug. 6, 2010 (10 pages).

*Primary Examiner* — Jeffrey J Restifo

(74) *Attorney, Agent, or Firm* — Knobbe Martens Olson & Bear, LLP

(57) ABSTRACT

Some embodiments are directed to a board for riding on a snow surface, comprising a base having a first snow engaging element, a second snow engaging element, and a third snow engaging element positioned on a bottom surface of the base. The first snow engaging element can be positioned beneath a user's front foot during operation of the board and positioned entirely on a forward half of the base. The second and third snow engaging elements can be positioned such that a fore portion of each is positioned beneath a user's front foot during operation of the board and extends toward the rear portion of the board at least to the user's rear foot. In some embodiments, the snow engaging elements can be protrusions, depressions, or otherwise, and can be removably supported by the base.

22 Claims, 19 Drawing Sheets

U.S. PATENT DOCUMENTS

| | | | | |
|---|---|---|---|---|
| 6,626,444 | B2 * | 9/2003 | Noble | 280/28 |
| 6,955,236 | B2 * | 10/2005 | Roberts et al. | 180/182 |
| 6,991,056 | B2 * | 1/2006 | Roberts et al. | 180/182 |
| RE39,012 | E * | 3/2006 | Noble et al. | 280/28 |
| 7,017,695 | B2 * | 3/2006 | Meunier et al. | 180/182 |
| 7,311,165 | B2 * | 12/2007 | Roberts et al. | 180/182 |
| 7,311,166 | B2 | 12/2007 | Roberts et al. | |
| 7,487,974 | B2 * | 2/2009 | Dick et al. | 280/28 |
| 7,500,679 | B2 * | 3/2009 | Wade | 280/28 |
| 7,841,089 | B2 * | 11/2010 | Roberts et al. | 29/897.2 |
| 2001/0019198 | A1 | 9/2001 | Wolf | |
| 2002/0121765 | A1 * | 9/2002 | Wolf | 280/609 |
| 2004/0032113 | A1 | 2/2004 | Rancon et al. | |
| 2004/0213960 | A1 | 10/2004 | Riepler | |
| 2008/0088100 | A1 | 4/2008 | Wagner | |
| 2011/0204596 | A1 * | 8/2011 | McLeod et al. | 280/609 |

FOREIGN PATENT DOCUMENTS

| | | |
|---|---|---|
| WO | WO 98/42418 | 1/1998 |

* cited by examiner

SNOWBOARD

PRIORITY INFORMATION AND INCORPORATION BY REFERENCE

This application is a continuation of U.S. patent application Ser. No. 12/852,293 (titled "SNOWBOARD"), filed Aug. 6, 2010, which claims priority benefit of U.S. Provisional Application 61/232,311 (titled "SNOWBOARD"), filed Aug. 7, 2009. Each of the above-listed applications is hereby incorporated by reference as if set forth herein in their entireties.

BACKGROUND

Field of the Disclosure

The present disclosure relates to snowboards and similar snow riding apparatuses.

SUMMARY

Some embodiments disclosed herein are directed to a board for riding on a snow surface, comprising a base comprising side edges, a top surface, a bottom surface, a fore portion, a rear portion, and a mid portion between the fore portion and the rear portion, wherein the fore portion and the rear portion of the base are each upwardly curved away from the bottom surface of the base; and a first longitudinal protrusion, a second longitudinal protrusion, and a third longitudinal protrusion extending from the bottom surface of the base; wherein the first longitudinal protrusion is positioned beneath a user's front foot during operation of the board, the first longitudinal protrusion being positioned entirely on a forward half of the base; the first longitudinal protrusion defines an axial centerline that is collinear with the longitudinal centerline of the base; the second longitudinal protrusion is positioned such that a fore portion of the second longitudinal protrusion is positioned beneath a user's front foot during operation of the board, the second longitudinal protrusion extending toward the rear portion of the board at least to the user's rear foot; the third longitudinal protrusion is positioned such that a fore portion of the third longitudinal protrusion is positioned beneath a user's front foot during operation of the board, the third longitudinal protrusion extending the rear portion of the board at least to the user's rear foot; and at least one of the first longitudinal protrusion, second longitudinal protrusion, and third longitudinal protrusion defines a profile that is curved in a widthwise direction.

In some embodiments, at least one of the longitudinal protrusions can define an asymmetrical cross-section. For example, without limitation, some embodiments of the longitudinal protrusions can define a cross-section having a gradually sloping inside surface and a more abruptly sloping outside surface. Additionally, in some embodiments, one two or more protrusions can be formed or positioned on the base of the board. For example, without limitation, the board can have two side protrusions (e.g., the second and third longitudinal protrusions) without the fore or first longitudinal protrusion.

Some embodiments disclosed herein are directed to a board for riding on a snow surface, comprising a base comprising side edges, a top surface, a bottom surface, a forward end portion, a mid portion, and a rear end portion, wherein the forward end portion and the rear end portion of the base are each upwardly curved away from the bottom surface of the base; and a first longitudinal protrusion, a second longitudinal protrusion, and a third longitudinal protrusion extending from the bottom surface of the base; wherein the first longitudinal protrusion is positioned closer to the forward end portion of the base than the second longitudinal protrusion and the third longitudinal protrusion; the first longitudinal protrusion being positioned entirely on a forward half of the base and defines an axial centerline that is collinear with the longitudinal centerline of the base; the second and third longitudinal protrusions are positioned such that a rear portion of each the second and third longitudinal protrusions are closer to the rear end portion of the base than the first longitudinal protrusion; at least one of the first longitudinal protrusion, second longitudinal protrusion, and third longitudinal protrusion defines a profile that is curved in a widthwise direction.

In any of the embodiments disclosed herein, the board can define one or more depressions formed in the base of the board. In some embodiments, the depressions can have the same or similar number, length, cross-sectional size, shape, and/or position of any protrusion or protrusions disclosed herein. One or more of the depressions formed in the board can be generally linear shaped, or can define a curved shape along the length thereof. Additionally, in some embodiments, the depression or depressions can have the same or similar width profile as compared to any of the embodiments of the protrusions disclosed herein but which, instead of extending away from the lower surface of the board, are cut or formed into the bottom surface of the board. In some embodiments, the depression or depressions can have a scalloped width and/or an undulated depth. In some embodiments, one or more of the depressions can have an approximately rectangular cross-sectional shape, a curved or semi-circular cross-sectional shape, an angled or triangular cross-sectional shape, or any combination thereof along the length thereof, or any other suitable shape.

Additionally, in any of the embodiments disclosed herein, the board can define one or more channels formed in the base of the board, the channels being configured to receive one or more removable inserts. As will be described in greater detail, the inserts can have a positive profile (so that a portion of the positive insert extends away from a bottom surface of the board when the insert is inserted into the channel), a negative profile (so that a portion of the negative insert defines a depression that extends beyond a bottom surface of the board when the insert is inserted into the channel), a neutral profile (so that the neutral insert fills the channel to make the bottom surface of the snowboard generally level or flush), or any combination thereof. In some embodiments, the channels can have approximately the same length as compared to any of the protrusions disclosed herein. Further, in some embodiments the board can define any combination of one or more protrusions, one or more depressions, and/or one or more channels formed therein and any combination of the positive, negative, and neutral inserts.

Accordingly, some embodiments disclosed herein are directed to a board for riding on a snow surface, comprising a base comprising side edges, a top surface, a bottom surface, a fore portion, a rear portion, and a mid portion between the fore portion and the rear portion, wherein the fore portion and the rear portion of the base are each upwardly curved away from the bottom surface of the base, at least one channel formed in the base of the board, the at least one channel extending through the bottom surface of the board, and at least one insert configured to be supported by the at least one channel such that at least a portion of the at least one insert is positioned within the at least one channel. The insert can have a positively projecting portion extending away from a bottom surface of the board, a negatively projecting portion extending into the board away from the bottom surface of the board, and/or a neutral portion being flush with a bottom surface of the board, or any combination thereof.

Some embodiments disclosed herein are directed a board for riding on a snow surface, comprising a base having side edges, a top surface, a front end, a back end, and a bottom surface, and a first snow engaging element, a second snow engaging element, and a third snow engaging element each positioned on the bottom surface of the base. In some embodiments, the first snow engaging element can be positioned approximately along a longitudinal centerline of the base and so as to be at least partially beneath a user's front foot during operation of the board, the first snow engaging element being positioned entirely on a forward half of the base, the second snow engaging element can be offset from the longitudinal centerline of the base and is at least positioned under the user's rear foot, the third snow engaging element can be offset from the longitudinal centerline of the base and is at least positioned under the user's rear foot, and/or the second snow engaging element and the third snow engaging element can be symmetrically positioned relative to the longitudinal centerline of the base.

Some embodiments disclosed herein are directed a board for riding on a snow surface, comprising a base comprising side edges, a top surface, a bottom surface, a fore portion, a rear portion, and a mid portion between the fore portion and the rear portion, wherein the fore portion and the rear portion of the base are each upwardly curved away from the bottom surface of the base, at least one channel formed in the base of the board, the at least one channel extending through the bottom surface of the board, and at least one insert configured to be supported by the at least one channel such that at least a portion of the at least one insert is positioned within the at least one channel. At least one insert can be removably supported by the board. At least one insert can be supported by the board using double sided adhesive, which can be positioned on a rearward portion of the insert. At least one insert supported by the board can have a portion that projects beyond the bottom surface of the board and/or a depression formed therein, the depression having a depth that extends into the board away from the bottom surface of the board. Alternatively, at least one insert can have a size and shape that is approximately the same as the size and shape of at least one of the channels so as to form a flush surface with the bottom surface of the board. In some embodiments, the board can have three or more channels configured to each receive an insert.

As the user progresses or as conditions change, inserts having a positively projecting surface can be removed from the board and replaced with inserts having lesser projecting surface, a different shaped projecting surface, a negatively projecting surface (i.e., depression), or with inserts having a neutral surface (which generally returns the board to its original surface contour). The negatively projecting surface can be configured to engage the snow surface to provide lateral stability to the board and enhance the ability of the user to learn to turn the board, but to a lesser extent as compared to an insert positively projecting surface.

DETAILED DESCRIPTION

Figure 1:
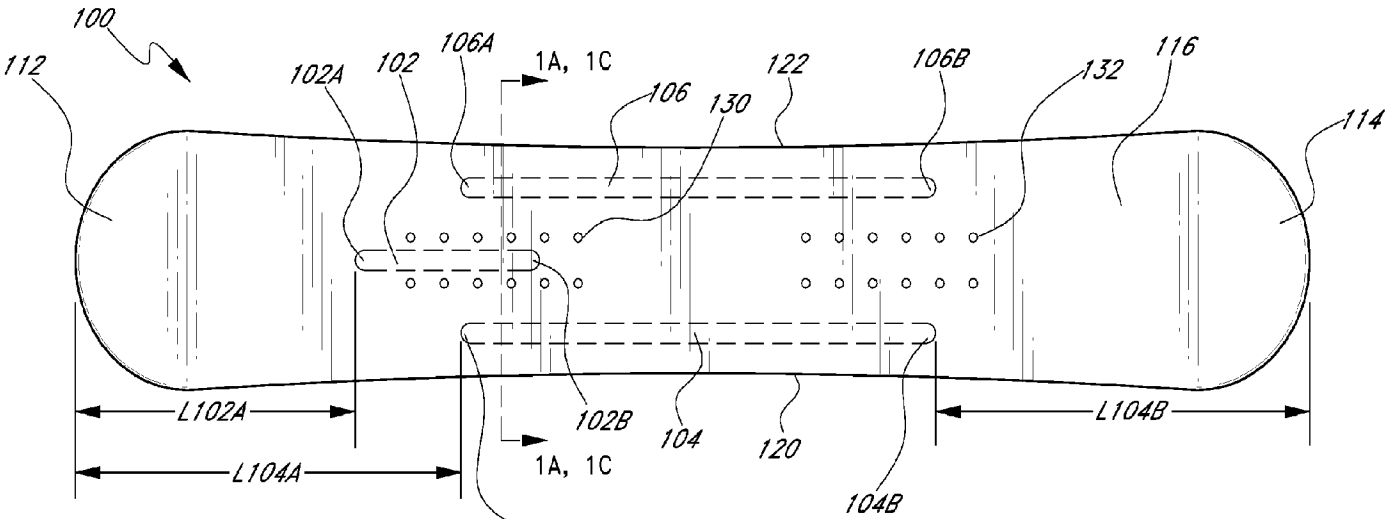
FIG. 1 is a top view of an embodiment of a snowboard showing generally lengthwise protrusions formed or positioned on a bottom surface of the snowboard in dashed lines for reference.

Some embodiments of the snowboards or other similar snow riding apparatuses (collectively, "snowboards") set forth in this disclosure can be configured to provide a snow riding platform to which a user or rider can be supported or affixed by bindings. Additionally, any of the embodiments of the snowboards set forth in this disclosure can be configured such that the user or rider can stand on the top surface of the snowboard in a bindingless arrangement so that the rider is not attached or affixed to the snowboard. Such bindingless snowboards may be shorter than the embodiments of the snowboards disclosed and illustrated herein. Additionally, any of the embodiments of the snowboards set forth in this disclosure can be configured such that a rider's feet can be attached to the snowboard base using an intermediate attachment system such as, without limitation, a system comprising a hook and loop attachment means (e.g., Velcro) on the bottom surface of the boots and at least a portion of the top surface of the snowboard. These embodiments, having the intermediate attachment system, can have a similar shape, similar features, and other similar characteristics as compared to other conventional snowboards.

In some embodiments, the bottom surface of the base can comprise one or more motion damping features or generally lengthwise extending snow engaging elements that can be configured to attenuate or slow many or all of a snowboard's natural movement characteristics, while not overwhelmingly attenuating those characteristics, in a wide range of snow conditions and slope angles. In some embodiments, the snow engaging elements can comprise protrusions that can project away from a bottom surface of the base or board, depressions or channels formed in the base, inserts positioned within channels formed in the base, or other similar or suitable features. For example, in some embodiments, depending on the shape and configuration of the snow engaging elements and the weight loading by the rider of different portions of the snowboard, the snow engaging elements can be configured to slow a snowboard's movement or velocity in the longitudinal direction by approximately 15%, or between approximately 5% or less and approximately 30% or more, or between approximately 10% and approximately 20%. In some embodiments, depending on the shape and configuration of the snow engaging elements and the weight loading by the rider of different portions of the snowboard, the snow engaging elements can be configured to slow a snowboard's movement or velocity in the lateral direction (i.e., transverse to the longitudinal centerline of the snowboard) by approximately 25%, or between approximately 10% or less and approximately 40% or more, or between approximately 20% and approximately 30%.

The various embodiments of the generally lengthwise extending snow engaging elements disclosed herein can thereby ease the learning process for new snowboarders, increase rider safety by reducing the number of falls a beginner or novice snowboarder will experience, and reduce rider fatigue. By damping a snowboard's otherwise unrestricted movement, particularly laterally, a new or casual rider can be afforded more time to correct a moments of imbalance and loss of control so that the rider can regain control before catching an edge, or otherwise crashing or falling down. Because the snow engaging elements can reduce the number of falls that a learning snowboarder typically experiences, the user can experience the least mental and physical fatigue as compared to a user of a conventional snowboarder.

Additionally, the unique configuration of the snow engaging elements of the embodiments of the snowboards disclosed herein can make it easier for a learning snowboarder to pause on a downhill slope and take a break while in a standing position. Users of conventional snowboards must typically sit or kneel to stop on a downhill slope to take a break, and returning to a standing position from a sitting or kneeling position often results in falls and also can significantly affect the stamina or energy level of a user. Therefore, by attenuating the longitudinal and lateral movement of the snowboard and thereby allow a user to take a break in a standing position, the unique configuration of the snow engaging elements of the embodiments of the snowboards disclosed herein can help a learning snowboarder maintain a greater level of energy while using the snowboard.

The unique configuration of the snow engaging elements of the embodiments of the snowboards disclosed herein and the lateral and longitudinal damping effects that can result from such can also improve a user's ability to go from a sitting or kneeling position to a standing position. Further, the unique configuration of the snow engaging elements disclosed herein can also improve a user's ability to perform "hop turns," a technique that is often used by snowboard instructors and is also often included in teaching manuals. The hop turns essentially is performed when a user jumps into the air thereby lifting the snowboard off the surface of the snow while simultaneously turning the snowboard to redirect the snowboard into a different direction, thereby allowing a rider or user to change their direction of motion. The increased longitudinal and lateral stability that can be afforded by some embodiments of the snow engaging elements disclosed herein can facilitate a user's ability to perform such hop turns, which can be very difficult for beginner and novice snowboarders to perform on conventional snowboards.

The snow engaging elements can damp or attenuate the motion of the snowboard in both the longitudinal and lateral directions, or, in some embodiments, in 360 degrees to aid in speed control, directional control, and safety for the user. In some embodiments, as will be described herein, the damping features or snow engaging elements can be longitudinal protrusions, which can be long, narrow rectangular protrusions extending from the bottom surface of the snowboard or can be approximately spherical protrusions in any surface of the snowboard at a variety of locations on the snowboard. The spherical protrusions can be linearly arranged along a lengthwise axis of the snowboard base. The damping features or snow engaging elements can be depressions or channels formed in the base of the board, or removable inserts supported within depressions or channels formed in the base of the board, or other suitable or similar elements.

In some embodiments, the protrusions or the snow engaging elements can have an ovular, circular, or otherwise curved surface in a widthwise direction of the protrusions or the snow engaging elements. Further, in some embodiments, the protrusions or the snow engaging elements can have a generally flat snow contact surface. For example, without limitation, the protrusions or the snow engaging elements can have generally curved or angled side portions and a generally flat bottom surface (the bottom surface being the surface of the protrusion or the snow engaging element that contacts the snow when the snowboard is resting flat against the snow surface). Having a curved or flattened surface in a widthwise direction can enhance the lateral stability of the snowboard while still allowing some cross-flow of snow across the bottom surface of the snowboard, hence, across the longitudinal protrusions or the snow engaging elements. In other words, this configuration can provide a resistance of the snowboard to sliding laterally, while not preventing such lateral sliding altogether. Some embodiments of the protrusions or the snow engaging elements herein provide some level of lateral stability while also allowing a beginner or novice snowboarder the ability to rotate or slide the tail or rear portion of the snowboard. The protrusions or the snow engaging elements thereby can be configured to permit a user to laterally slide some or all of a snowboard when a user so desires, based in part on the weight forces the rider exerts on the snowboard, but also providing some lateral damping effect so as to provide some level of lateral stability to the snowboard. Conventional snowboards having generally flat, planar bottom surfaces provide little or no lateral stability to a user when the bottom surface of the snowboard lies flat against the snow surface.

Figure 19:
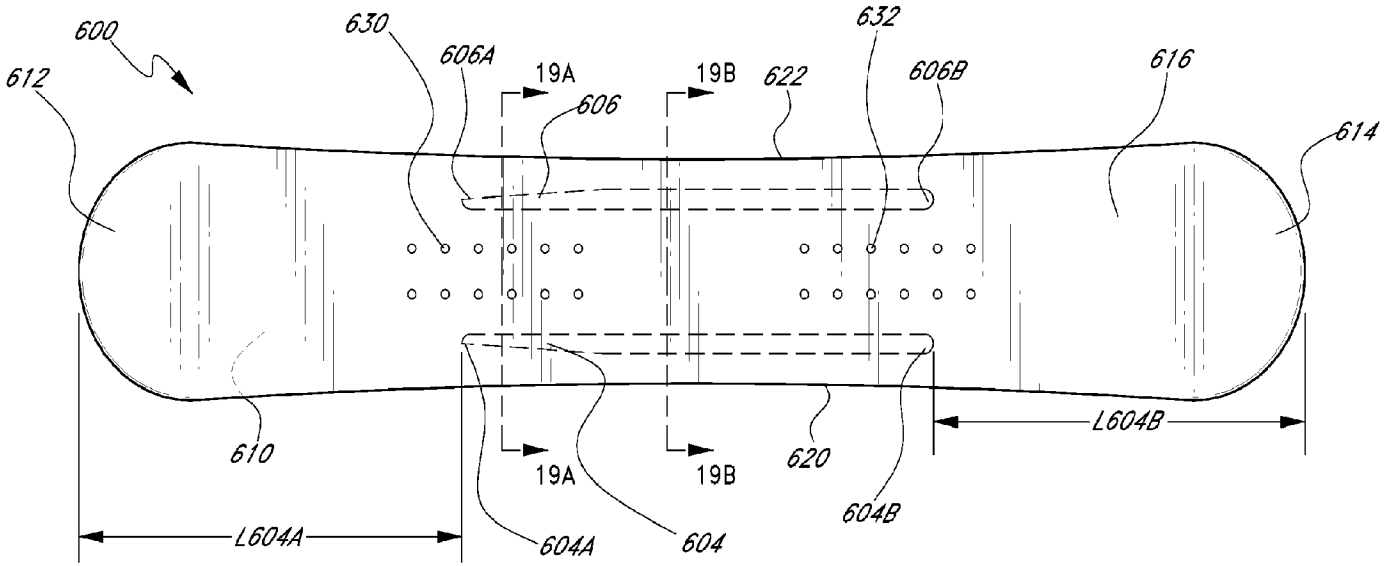
FIG. 19 is a top view of another embodiment of a snowboard showing generally lengthwise protrusions formed or positioned on a bottom surface of the snowboard in dashed lines for reference.
Figure 20:
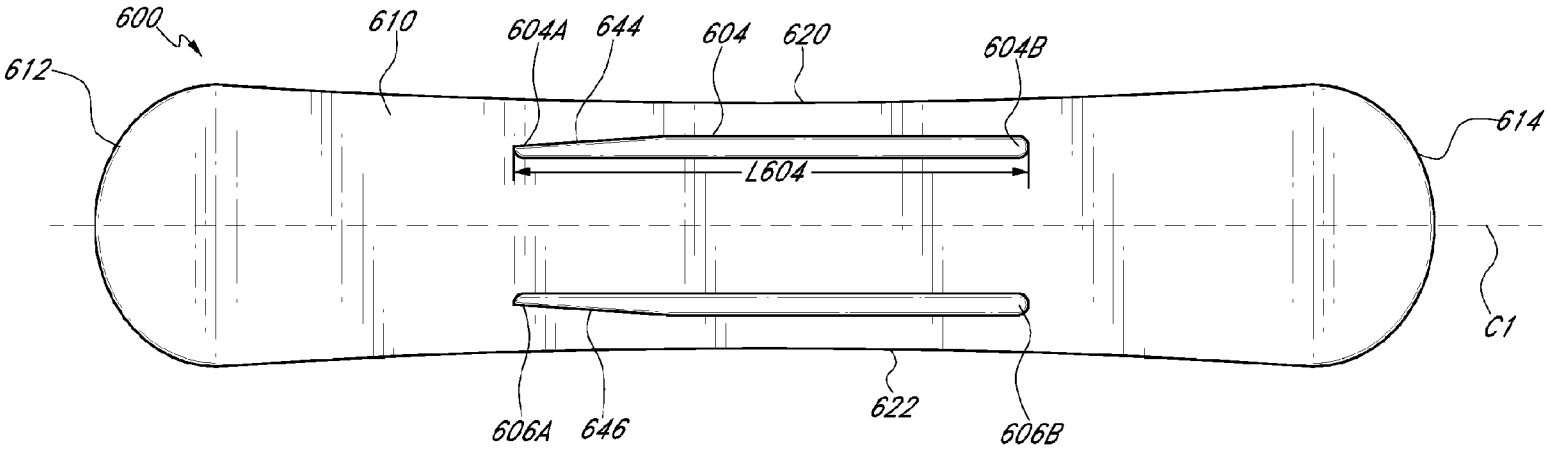
FIG. 20 is a bottom view of the embodiment of the snowboard shown in FIG. 19.
Figure 21:
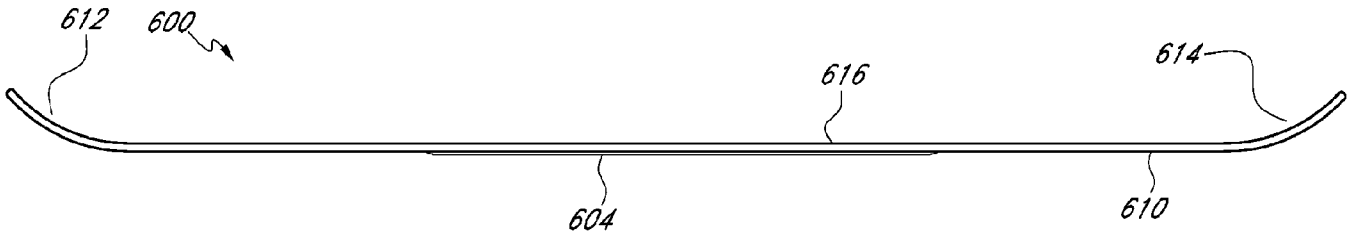
FIG. 21 is a side view of the embodiment of the snowboard shown in FIG. 19.

In some embodiments, at least one of the protrusions or the snow engaging elements formed or positioned on the base can have an asymmetrical or varying cross-section along at least a portion of the length thereof (such as, without limitation, illustrated in FIGS. 19-21). For example, without limitation, some embodiments of the longitudinal side protrusions or the snow engaging elements can define a cross-section having a gradually sloping inside surface and a more abruptly sloping outside surface. This configuration can assist the board with initiating a turn and providing more lateral resistance relative to the snow surface in a lateral direction pointing to the outside of the side protrusions or the snow engaging elements when the side protrusions or the snow engaging elements are engaged with the snow surface, while exerting less lateral resistance relative to the snow surface in a lateral direction pointing to the inside of the side protrusions or the snow engaging elements when the side protrusions or the snow engaging elements are engaged with the snow surface. In other words, this configuration can result in greater lateral resistance relative to snow moving across the protrusions or the snow engaging elements in a direction from an outside to an inside surface of the side protrusions or the snow engaging elements, and less lateral resistance relative to snow moving across the protrusions or the snow engaging elements in a direction from an inside to an outside surface of the side protrusions or the snow engaging elements.

As will be described, the snow engaging elements can extend along a predetermined length of the base of the snowboard in a lengthwise direction, or can comprise segments that are aligned with one another along lengthwise portion of the base in a linear or non-linear pattern. The snow engaging element segments can define spaces or intervals between the segments that can allow for the cross-flow of snow therebetween in the lateral direction, so as to allow a user to slide the rear portion of the snowboard to some extent. In some embodiments, the segments can be short (i.e., approximately 20% or less of the total length of the snow engaging elements), while in some embodiments, the segments can be longer (i.e., approximately 30% or more of the total length of the snow engaging elements).

In some embodiments, the profile thickness, width, shape, depth, and/or other details of the snow engaging elements can be selected or optimized based on the snow conditions. For example, without limitation, the depth or thickness of the snow engaging elements (i.e., the extent to which the snow engaging element projects into or away from the base or bottom surface of the base) can be greater for softer or deeper snow conditions, and can be smaller for harder or firmer snow conditions. In some embodiments, the profile thickness of longitudinal protrusions can be approximately 0.25 in. In some embodiments, the profile thickness of one or more of the longitudinal protrusions can be from approximately 0.075 in or less to approximately 0.50 in or more, or from approximately 0.125 in to approximately 0.250 in, or from approximately 0.20 in to approximately 0.40 in or more.

In some embodiments, the profile depth or thickness of one or more of the snow engaging elements or protrusions can be uniform along the length of the snow engaging element or protrusion, or, in some embodiments, can vary along the length thereof. In particular, in some embodiments, the profile depth or thickness can be the greatest in the front or fore portion of the snow engaging elements or longitudinal protrusion, respectively, and can progressively diminish along the length of the snow engaging element or longitudinal protrusion toward the rear portion thereof, or vice versa. In some embodiments, the depth or thickness of the protrusions can be greater in particular portions of the protrusions, such as without limitation the center portions of the protrusions, and less in other portions of the protrusions. The profile depth or thickness can linearly or non-linearly diminish or increase along the length thereof.

In some embodiments, the profile thickness of one or more of the longitudinal protrusions supported on the bottom surface of the snowboard can define an approximately uniform first profile thickness (such as, without limitation, 0.125 in) for at least a portion of the length thereof (such as, without limitation, approximately 3 in to approximately 6 in of the length thereof) at the forward portion of the longitudinal protrusion, and then gradually taper down along the remainder of the length thereof to a second profile thickness (such as, without limitation, 0.10 in or less, or 0.0625 in) at the rearward portion of the longitudinal protrusion or snowboard. In some embodiments, the second profile thickness can be zero, such that the longitudinal protrusion tapers until flush with the bottom surface of the snowboard. Alternatively, in some embodiments, the profile thickness of one or more of the longitudinal protrusions supported on the bottom surface of the snowboard can define an approximately uniform first profile thickness (such as, without limitation, 0.125 in) for portion of the length thereof (such as, without limitation, approximately 3 in to approximately 6 in) at the rearward portion of the longitudinal protrusion, and then gradually taper down along the remainder of the length thereof to a second profile thickness (such as, without limitation, 0.0625 in) at the forward portion of the longitudinal protrusion or snowboard.

In some embodiments, the leading surface or fore portion of one or more of the snow engaging elements or protrusions can be beveled or otherwise angled so as to form a modified bull nose shape which can project rapidly or abruptly away from the generally flat (although slightly curved) bottom surface of the snowboard. In this arrangement, for example, the longitudinal protrusion can exert a force on the snow surface during operation of the snowboard so as to slow the movement or speed of the snowboard in the longitudinal direction. In some embodiments, the leading surface of a portion of one or more of the longitudinal protrusions can be gradually angled so as to minimize the damping effect of the longitudinal protrusions in the longitudinal direction. In some embodiments, the leading surface of a portion of one or more of the longitudinal protrusions can be the spherically shaped, or generally flat but angled.

Alternatively, in some embodiments, one or more of the longitudinal protrusions can define an undulating, broken (i.e., dashed), or otherwise non-uniform profile along the length of the protrusions so that, without limitation, portions of the protrusions extend further away from the bottom surface of the base than other portions of the protrusions. As an example, without limitation, one or more the longitudinal protrusions can define cutouts along the length thereof so that the profile of the longitudinal protrusions appears to be wave-like. In some embodiments, the cut-outs can allow for greater cross-flow of snow laterally across the longitudinal protrusions and can, in some embodiments, provide a greater slowing effect to the snowboard in the longitudinal direction. In some embodiments, the cutouts can be configured so as to minimize the effect of the cutouts on the velocity of the snowboard in the longitudinal direction. In some embodiments, one or more of the longitudinal protrusions can define cutouts defining a non-curved shape, such as triangular, rectangular, trapezoidal, or other suitable shapes.

In some embodiments, where one or more of the longitudinal protrusions define an undulating profile, the undulating profile can be sized and configured so that the effect of the protrusions on damping lateral and longitudinal movement of the snowboard can be different than that of a longitudinal protrusion having a uniform profile. Further, in some embodiments, the undulating profile can vary along the length of the longitudinal protrusions. For example, without limitation, the depth of the cutouts can vary along the length of a longitudinal protrusion. Additionally, in some embodiments, the profile thickness of one or more of the longitudinal protrusions can vary along the length of the longitudinal protrusion.

The longitudinal protrusions can be manufactured separate from the other components comprising the bottom surface of the snowboard base and thereafter a fixed to the bottom surface of the snowboard using any suitable techniques, adhesives, or other materials, including without limitation epoxy, screws, and other fasteners. In some embodiments, the longitudinal protrusions can be manufactured integrally with the bottom surface of the snowboard base. As such, the longitudinal protrusions can be formed from polyethylene, P-Tex, or other suitable plastic, and can be extruded, stamped, sintered, or otherwise formed using any suitable manufacturing process.

Figure 1C:
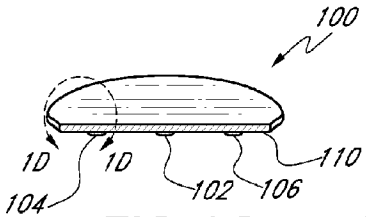
FIG. 1C is a section view of the embodiment of the snowboard shown in FIG. 1 taken through line 1C-1C in FIG. 1.
Figure 1D:
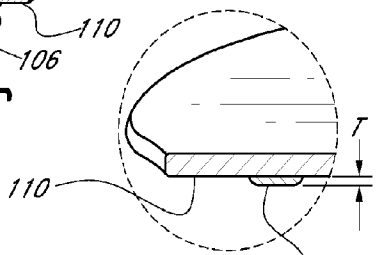
FIG. 1D is an enlargement of a portion of the section view shown in FIG. 1C, defined by curve 1D-1D in FIG. 1C.
Figure 1A:
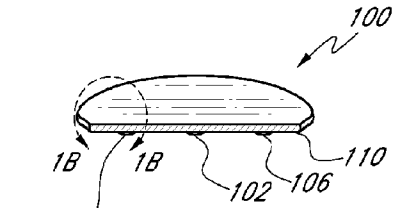
FIG. 1A is a section view of the embodiment of the snowboard shown in FIG. 1 taken through line 1A-1A in FIG. 1.
Figure 1B:
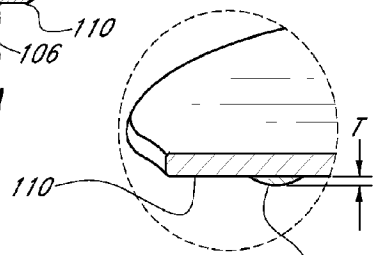
FIG. 1B is an enlargement of a portion of the section view shown in FIG. 1A, defined by curve 1B-1B in FIG. 1A.
Figure 2:
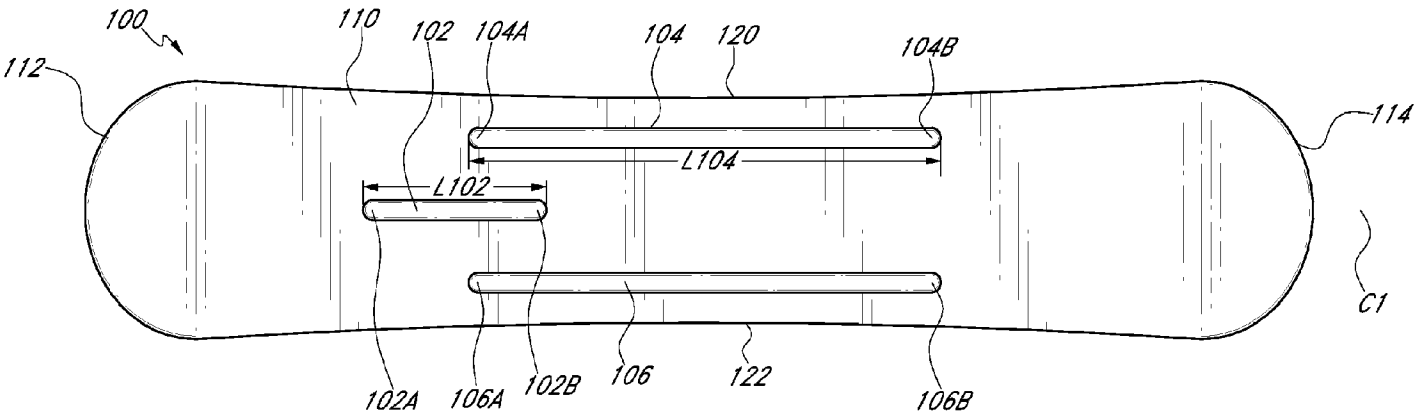
FIG. 2 is a bottom view of the embodiment of the snowboard shown in FIG. 1.
Figure 3:
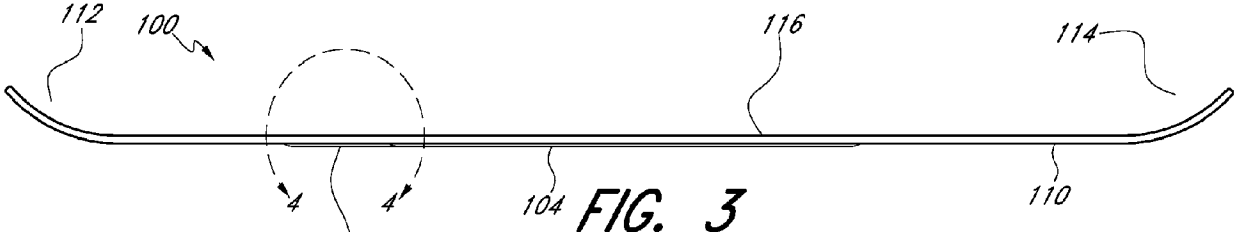
FIG. 3 is a side view of the embodiment of the snowboard shown in FIG. 1.
Figure 4:
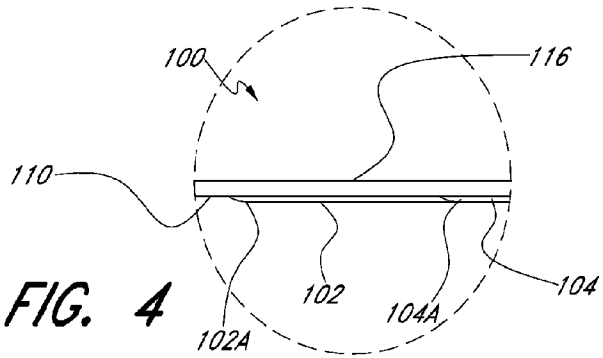
FIG. 4 is an enlarged side view of a portion of the embodiment of the snowboard shown in FIG. 1, defined by curve 4-4 in FIG. 3.

With reference to the figures, FIG. 1 is a top view of an embodiment of a snowboard 100 showing longitudinal protrusions 102, 104, 106 formed or positioned on a bottom surface 110 of the snowboard 100 in dashed lines for reference. FIG. 1A is a section view of the embodiment of the snowboard 100 shown in FIG. 1 taken through line 1A-1A in FIG. 1. FIG. 1B is an enlargement of a portion of the section view shown in FIG. 1A, defined by curve 1B-1B in FIG. 1A. FIG. 2 is a bottom view of the embodiment of the snowboard 100 shown in FIG. 1, and FIGS. 3 and 4 are, respectively, a side view of the embodiment of the snowboard shown in FIG. 1 and an enlarged side view of a portion of the embodiment of the snowboard shown in FIG. 1, defined by curve 4-4 in FIG. 3. As with any of the embodiments of snowboards disclosed herein, the snowboard 100 can have an upwardly curved nose or tip portion 112 (also referred to herein as a fore portion), an upwardly curved tail portion 114 (also referred to herein as a rear or rearward portion), a top surface 116, and side surfaces or edges 120, 122.

In some embodiments, the snowboard 100 or any other snowboard disclosed herein can also have a flat tail portion (not illustrated), a split tail or swallow-tail portion (not illustrated), or any other suitable configuration in the nose portion 112, tail portion 114, or any other portion of the snowboard.

Further, in some embodiments, the snowboard 100 or any other embodiments of snowboards disclosed herein can have an upwardly curved or so-called reverse cambered bottom surface. Alternatively, in some embodiments, the snowboard 100 or any other embodiments of snowboards disclosed herein can have a flat bottom surface or a conventionally curved bottom surface. The side surfaces 120, 122 or any other side surfaces of any other embodiments disclosed herein can be inwardly curved (as illustrated), or can be flat (i.e., generally linear), or outwardly curved. In some embodiments, the side surfaces 120, 122 or any other side surfaces of any other embodiments disclosed herein can define one or more curved surfaces (e.g., radially curved, progressively curved, etc.), or can define a waving, undulating side surface defining a plurality of curves that can be sinusoidally or otherwise cyclically repeating. The snowboard 100 can have a metal rail along at least a portion of the side surfaces 120, 122, and also along at least a portion of the nose portion 112 and/or the tail portion 114. The embodiments of the longitudinal protrusions disclosed herein can be configured and adapted for use with any shaped snowboard.

Additionally, in some embodiments, threaded inserts 130 (which can be metal) can be supported in the snowboard 100 so as to form a plurality of the openings through the top surface 116 of the snowboard 100 in the middle and/or forward portion of the snowboard 100. Any of the embodiments of the snowboards disclosed herein can be formed without threaded inserts. The inserts are discussed herein as an example of where a user's front or rear foot can be positioned on some embodiments of the snowboards disclosed herein relative to the longitudinal protrusions. However, the position of the user's foot or the inserts is not limited to the positions disclosed herein.

The threaded inserts 130 can be configured to threadingly receive bolts from bindings that can be configured to support a user's front foot. Similarly, in some embodiments, threaded inserts 132 (which can be metal) can be supported in the snowboard 100 so as to form a plurality of the openings through the top surface 116 of the snowboard 100 in the middle and/or rearward portion of the snowboard 100. The threaded inserts 132 can be configured to threadingly receive bolts from bindings that can be configured to support a user's rear foot. Alternatively, the top surface 116 of the snowboard can be configured such that a user can stand on the snowboard 100 without the use of bindings or such that a binding can be supported by the snowboard in an alternative manner. In such embodiments, the Velcro, grip tape, or other gripping features can be applied to the top surface 116 of the snowboard 100 to enhance the user's traction on the snowboard 100.

In some embodiments, as illustrated, the lead or center longitudinal protrusion 102 can be positioned in the lateral center of the snowboard 100, and can be positioned such that the forward portion 102A of the protrusion 102 is closer to the nose 112 of the snowboard 100 than the forward portions 104A, 106A of the side protrusions 104, 106. In any of the embodiments of the snowboards disclosed herein, the center protrusion 102 can be positioned such that all or a portion of the center protrusion 102 is positioned in a forward half of the snowboard. Additionally, in any of the embodiments of the snowboards disclosed herein, the center protrusion 102 can be positioned such that all or a portion of the center protrusion 102 is positioned below (i.e., in a direction toward the snow-facing surface of the board) or adjacent to the threaded inserts 130 designed to accommodate a user's front foot, or otherwise configured so that all or a portion of the center protrusion 102 can be positioned beneath a user's front foot.

In this configuration, for turning the snowboard 100 or any other snowboard disclosed herein, the user or rider may exert more weight over his front foot, simultaneously relieving pressure from the back foot and, hence, reducing the effect of the side protrusions 104, 106. With rider weight concentrated on the front of the snowboard 100, the effectiveness of the center protrusion 102 and, in some embodiments, the forward portion of the side protrusions 104, 106 if positioned far enough forward, can be increased so as to improve the user's ability to initiate a turn.

In any of the embodiments of the snowboards disclosed herein, two or more parallel oriented longitudinal protrusions 102 can be positioned symmetrically offset from the lateral center C1 of the snowboard 100. The longitudinal protrusion or protrusions 102 can each define a width of approximately 0.75 in, or from approximately 0.375 in or less to approximately 1.125 in or more. Additionally, in any of the embodiments of the snowboards disclosed herein, the profile of the leading longitudinal protrusions can be different than the profile of the rearward portion of the longitudinal protrusions.

The lead protrusion 102 can attenuate or damp the forward and/or lateral movement of the snowboard 100, particularly when a user presses down with his or her front foot on the forward portion of the snowboard 100 so as to exert a greater force or pressure on the center protrusion 102. Because the center protrusion 102 can be positioned such that all or a portion of the center protrusion 102 is in the forward portion of the snowboard 100 (i.e., the forward half of the snowboard), the effect of the center protrusion 102 can be increased and decreased by a user by altering the amount of weight or force that is exerted by a user's front foot on the fore portion of the snowboard 100 and, hence, on the center protrusion 102. For example, in some embodiments, the user can increase the damping effect that the lead protrusion 102 can exert on the lateral and/or longitudinal movement of the snowboard by varying the amount of weight that is exerted on the user's front foot. Additionally, because the lead protrusion 102 can be positioned closer to the nose portion 112 of the snowboard 100, the lead protrusion 102 can engage the snow surface at an advanced or earlier time or position as compared to the side protrusions 104, 106, so as to help engage the snow surface at an earlier point on the snowboard 100 as compared to the side protrusions 104, 106 and thus cause an earlier or more forward portion of the snowboard 100 to initiate a turn.

In some embodiments, even without exerting a greater force or pressure on the rider's front foot and, hence, the differential in terms of the number and/or volume of protrusions on the fore portion of the board relative to the rearward portion of the board due to the addition of the lead or center protrusion 102 can have a number of advantages. For example, the lead protrusion 102 can provide greater control for a rider of the fore portion of the board by increasing the number or volume of protrusions interacting with the snow in the fore portion of the snowboard. This increase in the number or volume of protrusions in the fore portion of the board can increase a user's ability to initiate and follow an intended path on the snowboard. Additionally, because the number or volume of protrusions in the fore portion of the board can be greater than the number or volume of protrusions in a rearward portion of the board, in some embodiments, the rearward portion of the board can be more easily slid laterally as compared to the fore portion. This can improve the ease by which a user can slide or laterally maneuver the tail of the board relative to the fore portion of the board when necessary.

As illustrated, the side protrusions 104, 106 can be symmetrically positioned so as to be offset from the longitudinal centerline C1. In some embodiments, the side protrusions

104, 106 can be sized and positioned such that the leading edges 104A, 106A of the protrusions 104, 106 are positioned in the forward half of the snowboard 100. In some embodiments, the side protrusions 104, 106 can be sized and positioned such that the leading edges 104A, 106A of the protrusions 104, 106 overlap or extended forward of the rearward edge or edges 102B of the center protrusion 102. However, in some embodiments, the side protrusions 104, 106 can be sized and positioned such that the leading edges 104A, 106A of the protrusions 104, 106 are spaced apart from the rearward edge or edges 102B of the center protrusion or protrusions 102 so that a significant space or cross-flow channel is created between the center protrusion or protrusions and the side protrusions 104, 106. Additionally, the side protrusions 104, 106 can be sized and positioned such that the leading edges 104A, 106A of the protrusions 104, 106 are positioned under or adjacent to a user's rear foot, the protrusions 104, 106 extending toward a rear end of the board. All of the dimensional and positional details discussed in this application can be applied to any of the other protrusions or other snow engaging elements disclosed herein.

In some embodiments, the side protrusions 104, 106 can be sized and positioned such that the leading edges 104A, 106A of the protrusions 104, 106 are positioned adjacent to at least some of the inserts 130 at the fore portion of the snowboard, such that a user's front foot can be positioned over the fore portions 104A, 106A of the protrusions 104, 106. The side protrusions 104, 106 can extend toward the tail portion 114 of the snowboard. In some embodiments, as in the illustrated embodiment, the protrusions 104, 106 can be sized and positioned such that the rearmost portions 104B, 106B of the side protrusions 104, 106 are positioned approximately adjacent to the threaded inserts 132 that are configured to support a user's rear foot, such that the rearmost portions 104B, 106B of the side protrusions 104, 106 can be positioned approximately under at least a portion of a user's rear foot. In some embodiments, where the side protrusions 104, 106 define approximately uniform cross-sections along the length thereof, terminating the side protrusions 104, 106 under a user's rear foot can result in a significant length of the rear portion of the snowboard that is free of the protrusions so as to increase a user's ability to slide or laterally move the tail portion 114 of the snowboard when needed.

In some embodiments, as illustrated, the protrusions 102, 104, 106 can be straight. In some embodiments, at least a portion of the side protrusions 104, 106 can be curved, angled, or otherwise nonlinear. For example, in some embodiments, each of the side protrusions 104, 106 can be curved so as to match the approximate curvature of the edges 120, 122 of the snowboard 100. In some embodiments, a forward portion of each of the side protrusions 104, 106 can be curved so as to match the approximate curvature of the edges 120, 122 of the snowboard 100, while a rearward portion of each of the side protrusions 104, 106 can be approximately linear. Curving the protrusions 104, 106 can improve the directional stability of the snowboard 100 and can help a user initiate a turn from a straight path.

The lead protrusion 102 can be configured so as to attenuate or damp the forward or lateral movement of the snowboard 100, particularly when a user presses down with his or her front foot on the forward portion of the snowboard 100 so as to exert a greater force or pressure on the center protrusion 102. Because the center protrusion 102 can be positioned such that all or a portion of the center protrusion 102 is in the forward portion of the snowboard 100, the effect of the center protrusion 102 can be increased and decreased by a user by altering the amount of weight or force that is exerted by a user's front foot and, hence, on the fore portion of the snowboard 100. Therefore, in some embodiments, the user can increase the damping effect that the lead protrusion 102 can exert on the lateral and/or longitudinal movement of the snowboard by varying the amount of weight that is exerted on the user's front foot. Additionally, because the lead protrusion 102 can be positioned closer to the nose portion 112 of the snowboard 100, the lead protrusion 102 can engage the snow surface at an advanced position as compared to the side protrusions 104, 106, so as to help engage the snow surface at an earlier point on the snowboard 100 as compared to the side protrusions 104, 106 and thus cause an earlier or more forward portion of the snowboard 100 to initiate a turn.

In some embodiments, the lead protrusion 102 and the side protrusions 104, 106 can be approximately straight and can have a generally uniform cross-sections along the length thereof. In some embodiments, as discussed above, the lead protrusion 102 and/or the side protrusions 104, 106 or any protrusions disclosed herein can have a generally curved surface in a widthwise direction along the length of the protrusion, as is illustrated in FIGS. 1A and 1B, or can have a generally flat snow contact surface, as is illustrated in FIGS. 1C and 1D. For example, without limitation, the protrusions can have generally curved or angled side portions and a generally flat bottom surface (the bottom surface being the surface of the protrusion that contacts the snow when the snowboard is resting flat against the snow surface). Additionally, the leading edges 102A, 104A, 106A of the protrusions 102, 104, 106 can be spherical, triangular, beveled, curved, tapered, rounded, or similarly shaped or configured. In some embodiments, the leading edges 102A, 104A, 106A of the protrusions 102, 104, 106 can have a generally flat angled surface. In some embodiments, the leading edges 102A, 104A, 106A of the protrusions 102, 104, 106 can each have a spherical shape. The rearward edges or portions 102B, 104B, 106B of the protrusions 102, 104, 106 can be similarly shaped.

In some embodiments, with reference to FIGS. 1-4, the length of the snowboard 110 can be approximately 55.25 in, the width of the snowboard at the nose portion 112 and tail portion 114 can be approximately 10.625 in, and the distance from the nose portion 112 to the inserts 130 can be approximately 15 in and can extend to approximately 22.5 in from the nose portion 112. The nose portion 112 of the snowboard 100 or of any other snowboard disclosed herein can rise to the distance approximately 2.375 in, or from approximately 2 in to approximately 2.75 in above the bottom surface of the snowboard. Similarly, the tail portion of 14 of the snowboard 100 or any other snowboard disclosed herein can rise to a distance of approximately 2.25 in, or from approximately 2 in to approximately 2.5 in above the bottom surface of the snowboard. These dimensions and the dimensional ranges disclosed herein are merely exemplifying and are not meant to indicate required or even preferable dimensions or dimensional ranges of the snowboards that are suitable for such longitudinal protrusions.

In some embodiments, the length of the center protrusion 102 can be approximately 8 in, or from approximately 6 in or less to approximately 14 in or more. In some embodiments, the center protrusion 102 can be positioned on the snowboard 110 such that the distance L102A from the nose 112 of the snowboard 110 to the leading edge 102A can be approximately 13 in, or from approximately 9 in or less to approximately 17 in or more, or from approximately 11 in or less to approximately 15 in or more.

Further, the distance from the rear portion 114 to the inserts 132 can be approximately 15 in and can extend to approximately 22.5 in from the rear portion 114. In some embodiments, the length of the side protrusions 104, 106 can be approximately 21 in, or from approximately 15 in or less to approximately 28 in or more, or from approximately 18 in to approximately 24 in. In some embodiments, the side protrusions 104, 106 can be positioned on the snowboard 110 such that the distance L104A from the nose 112 of the snowboard 110 to the leading edge 104A can be approximately 18 in, or from approximately 14 in or less to approximately 22 in or more.

In some embodiments, the side protrusions 104, 106 or any other side protrusions of any other snowboard disclosed herein can be positioned on the snowboard 110 such that the distance L104B from the rear portion 114 of the snowboard 110 to the rear edge 104B can be approximately 17 in, or from approximately 13 in or less to approximately 22 in or more, or from approximately 15 in or less to approximately 20 in or more. As mentioned above, terminating the side protrusions 104, 106 or any other side protrusions of any other snowboard disclosed herein a substantial distance from the rearward portion 114 of the snowboard can provide an increased distance of the rearward portion of the snowboard that has unobstructed cross-flow characteristics (i.e., similar to that of a conventional base) behind the rear foot of the user to permit the user to slide to tail portion of the snowboard relative to the snow surface. In some embodiments, as in the illustrated embodiment, the side protrusions 104, 106 or any other side protrusions of any other snowboard disclosed herein can be configured to terminate beneath the rear foot of the user such that a user can apply force to the side protrusions by exerting weight or force on the user's rear foot. In some embodiments, the side protrusions 104, 106 can be positioned so as to permit a user greater lateral stability to the snowboard for stopping purposes when a user desires to slow or stop the snowboard by engaging a side edge of the snowboard into the snow surface.

In some embodiments, the side protrusions of any of the snowboards disclosed herein can be configured and positioned relative to the lateral or side edges of the snowboard such that the side protrusions can contact the snow across the widest range of angles of the snowboard relative to the snow surface (i.e., when the snowboard is being tilted on an edge during a turn or otherwise such that one of the lateral edges contacts the snow while the other, opposite lateral edge is lifted off of the snow surface). In some embodiments, the side protrusions of any of the snowboards disclosed herein can be configured and positioned relative to the lateral edges of the snowboard such that the side protrusions contact the snow (in standard snow conditions) until the snowboard is tipped to an approximately 20 degree angle, at which time the edge of the snowboard 100 primarily contacts the snow. In some embodiments, the side protrusions of any of the snowboards disclosed herein can be configured and positioned relative to the lateral edges of the snowboard such that the side protrusions contact the snow (in standard snow conditions) until the snowboard is tipped to between an approximately 10 degree angle or less to an approximately 30 degree angle or more, or between an approximately 15 degree angle or less to an approximately 25 degree angle or more at which time the edge of the snowboard can primarily contact the snow. Thus, in some embodiments, the side protrusions 104, 106 can provide additional lateral stability relative to a conventional snowboard even when the snowboard is tipped up on an edge.

In some embodiments, the side protrusions 104, 106 can be positioned such that the centerline of the side protrusions 104, 106 can be at least approximately 1.2 in from the side edges 120, 122 of the snowboard. In some embodiments, the side protrusions 104, 106 can be positioned such that the centerline of the side protrusions 104, 106 can be at least from approximately 1.0 in or less to approximately 2.0 in or more, or from approximately 1.2 in to approximately 1.5 in from the side edges of the snowboard.

The width of each of the protrusions 102, 104, 106 or any other protrusions disclosed herein can be approximately 0.75 in., or from approximately 0.25 in or less to approximately 1.25 in or more, or from approximately 0.5 in or less to approximately 1.0 in or more. In some embodiments, the width of each of the protrusions 102, 104, 106 or any other protrusions disclosed herein can vary along the length of the protrusions through in some embodiments, with the protrusions at the forward portions of the protrusions can be smaller than the width of the protrusions at the center or at the trailing portions of the protrusions.

In some embodiments, the profile thickness (i.e., the extent to which the longitudinal protrusion projects away from the bottom surface 110 of the snowboard 100 or any other snowboard herein, such as is represented by thickness T in FIGS. 1B and 1D) of the longitudinal protrusions 102, 104, 106 or any other longitudinal protrusions disclosed herein can be approximately 0.125 in. In some embodiments, the profile thickness of any of the longitudinal protrusions disclosed herein can be from approximately 0.075 in or less to approximately 0.250 in or more, or from approximately 0.100 in or less to approximately 0.15 in or more.

Note that the dimensions and the dimensional ranges disclosed herein are merely exemplifying and are not meant to indicate required dimensions or dimensional ranges or limitations to the inventions. None of the exemplifying dimensions or dimensional ranges disclosed in this application is required. The dimensions of each of the protrusions 102, 104, 106 or any other protrusions disclosed herein can be any suitable value and each of the protrusions 102, 104, 106 or any other protrusions disclosed herein can be positioned at any suitable position on the snowboard. Further, the length and width of each of the protrusions as well as the longitudinal and lateral positioning of each of the protrusions can be dependent on the dimensions of the snowboard to which the protrusions are affixed, formed, or positioned on. Therefore, for example, without limitation, for snowboards having longer nose or forward portions, the protrusions can be positioned further from the nose portion of the snowboard and, hence, closer to the tail portion of the snowboard and/or may be shorter in length. In some embodiments, any of the forward or frontmost protrusions of any of the embodiments of the snowboards disclosed herein can be positioned such that the frontmost protrusions extend from the beginning of the contact surface at the front of the snowboard.

Figure 5:
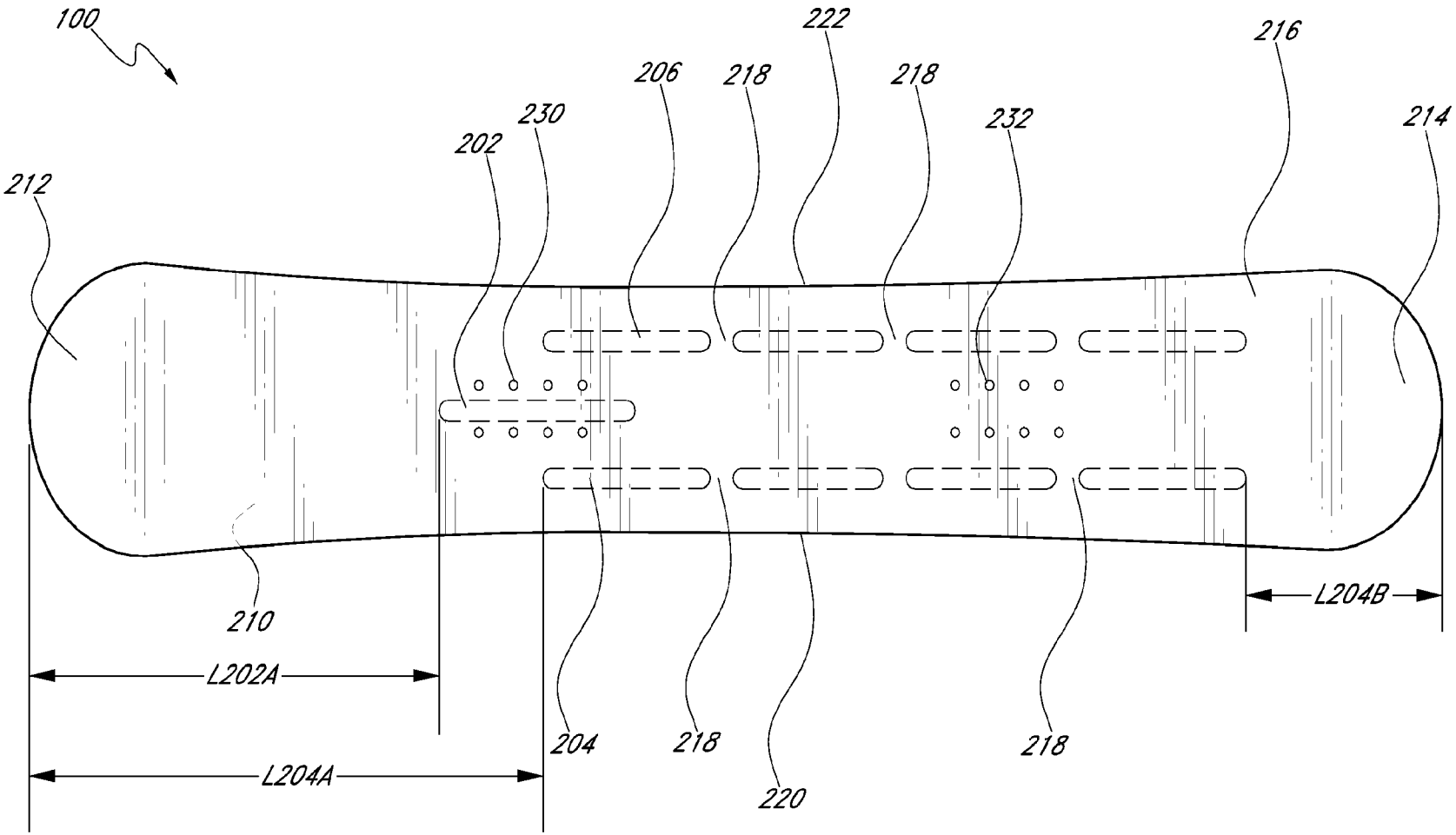
FIG. 5 is a top view of another embodiment of a snowboard showing generally lengthwise protrusions formed or positioned on the bottom surface of the snowboard in dashed lines for reference.
Figure 6:
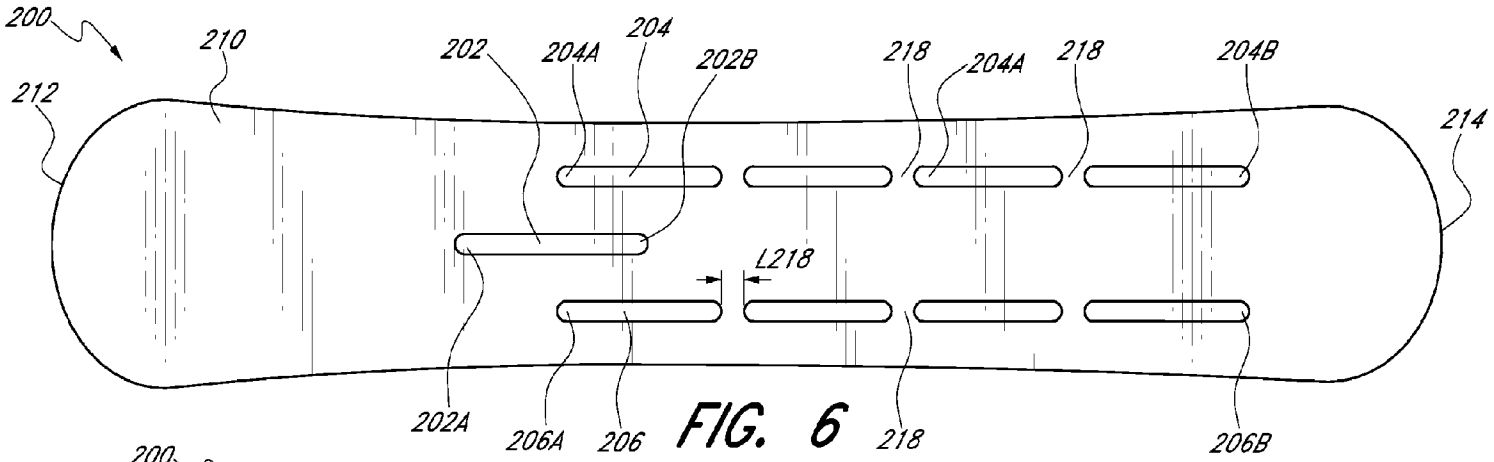
FIG. 6 is a bottom view of the embodiment of the snowboard shown in FIG. 5.
Figure 7:
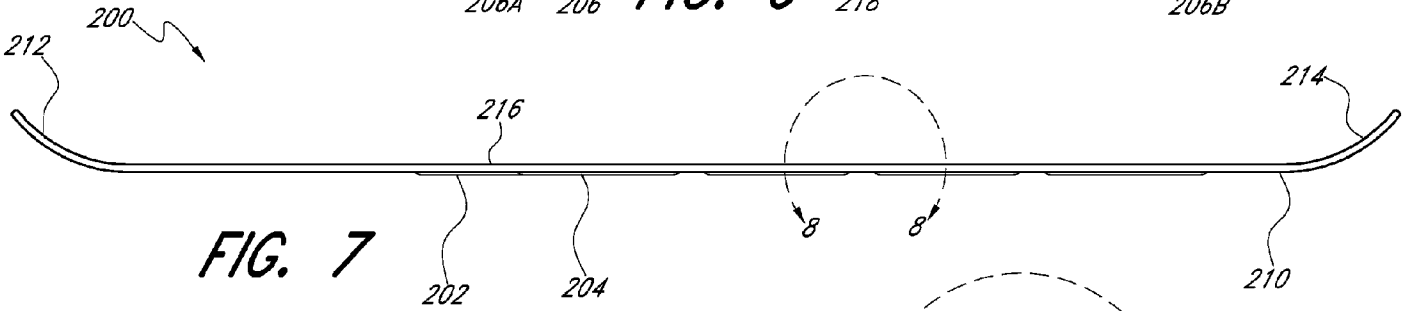
FIG. 7 is a side view of the embodiment of the snowboard shown in FIG. 5.
Figure 8:
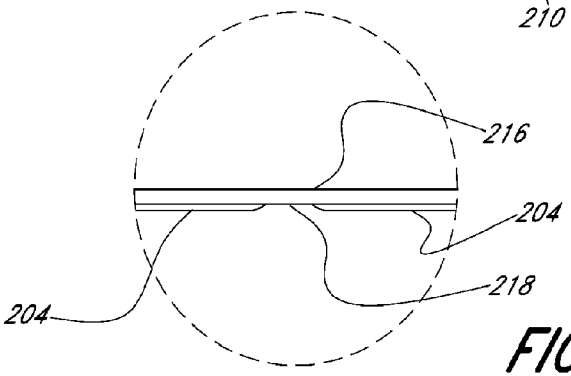
FIG. 8 is an enlarged side view of a portion of the embodiment of the snowboard shown in FIG. 5, defined by curve 8-8 in FIG. 7.

FIG. 5 is a top view of an embodiment of a snowboard 200 showing longitudinal protrusions 202, 204, 206 formed or positioned on a bottom surface 210 of the snowboard 200 in dashed lines for reference. FIG. 6 is a bottom view of the embodiment of the snowboard 200 shown in FIG. 5, and FIGS. 7 and 8 are, respectively, a side view of the embodiment of the snowboard shown in FIG. 5 and an enlarged side view of a portion of the embodiment of the snowboard shown in FIG. 5, defined by curve 8-8 in FIG. 7. As with any of the embodiments of snowboards disclosed herein, the snowboard 200 can have an upwardly curved nose or tip portion 212 (also referred to herein as a fore portion), an upwardly curved tail portion 214 (also referred to herein as a rear or rearward portion), a top surface 216, and side surfaces or edges 220, 222. Additionally, the snowboard 200 including the longitudinal protrusions 202, 204, 206 can have any of the dimensions, shapes, features, or other details of any of the other snowboards or longitudinal protrusions disclosed herein.

Similar to snowboard 100, in some embodiments, threaded inserts 230 (which can be metal) can be supported in the snowboard 200 so as to form a plurality of the openings through the top surface 216 of the snowboard 200 in the middle and/or forward portion of the snowboard 200 so as to threadingly receive bolts from bindings that can be configured to support a user's rear foot. Alternatively, the top surface 216 of the snowboard can be configured such that a user can stand on the snowboard 200 without the use of bindings or such that a binding can be supported by the snowboard in an alternative manner. In such embodiments, the Velcro, grip tape, or other gripping features can be applied to the top surface 216 of the snowboard 200 to enhance the user's traction on the snowboard 200.

In some embodiments, as illustrated, the leading longitudinal protrusion 202 can be positioned in the lateral center of the snowboard 200, and can be positioned such that the forward portion 202A of the protrusion 202 is closer to the nose 212 of the snowboard 200 than the forward portions 204A, 206A of the side protrusions 204, 206. In any of the embodiments of the snowboards disclosed herein, the center protrusion 202 can be positioned such that all or a portion of the center protrusion 202 is positioned in a forward half of the snowboard. Additionally, in any of the embodiments of the snowboards disclosed herein, the center protrusion 202 can be positioned such that all or a portion of the center protrusion 202 is positioned below or adjacent to the threaded inserts 230 designed to accommodate a user's front foot, or otherwise configured so that all or a portion of the center protrusion 202 can be positioned beneath a user's front foot.

In any of the embodiments of the snowboards disclosed herein (not illustrated), two or more parallel oriented longitudinal protrusions 202 can be positioned symmetrically offset from the lateral center C1 of the snowboard 200. The longitudinal protrusion or protrusions 202 can each define a width of approximately 0.75 in, or from approximately 0.375 in or less to approximately 1.125 in or more. Additionally, in any of the embodiments of the snowboards disclosed herein, the profile of the leading longitudinal protrusions can be different than the profile of the rearward portion of the longitudinal protrusions.

As illustrated, the side protrusions 204, 206 can be symmetrically positioned so as to be offset from the longitudinal centerline C1. In some embodiments, the side protrusions 204, 206 can be sized and positioned such that the leading edges 204A, 206A of the protrusions 204, 206 are positioned in the forward half of the snowboard 200. In some embodiments, the side protrusions 204, 206 can be sized and positioned such that the leading edges 204A, 206A of the protrusions 204, 206 overlap or extended forward of the rearward edge or edges 202B of the center protrusion or protrusions 202. However, in some embodiments, the side protrusions 204, 206 can be sized and positioned such that the leading edges 204A, 206A of the protrusions 204, 206 are spaced apart from the rearward edge or edges 202B of the center protrusion or protrusions 202 so that a significant space or cross-flow channel is created between the center protrusion or protrusions and the side protrusions 204, 206.

In some embodiments, the side protrusions 204, 206 can be sized and positioned such that the leading edges 204A, 206A of the protrusions 204, 206 are positioned adjacent to at least some of the inserts 230 at the fore portion of the snowboard, such that a user's front foot can be positioned over the fore portions 204A, 206A of the protrusions 204, 206. The side protrusions 204, 206 can extend toward the tail portion 214 of the snowboard. In some embodiments, as in the illustrated embodiment, the protrusions 204, 206 can be sized and positioned such that the rearmost portions 204B, 206B of the side protrusions 204, 206 are positioned approximately adjacent to the threaded inserts 232 that are configured to support a user's rear foot, such that the rearmost portions 204B, 206B of the side protrusions 204, 206 can be positioned approximately under at least a portion of a user's rear foot. In some embodiments, where the side protrusions 204, 206 define approximately uniform cross-sections along the length thereof, terminating the side protrusions 204, 206 under a user's rear foot can result in a significant length of the rear portion of the snowboard that is free of the protrusions so as to increase a user's ability to slide or laterally move the tail portion 214 of the snowboard when needed.

In some embodiments, as illustrated, the protrusions 202, 204, 206 can be straight. In some embodiments, at least a portion of the side protrusions 204, 206 can be curved, angled, or otherwise nonlinear. For example, in some embodiments, each of the side protrusions 204, 206 can be curved so as to match the approximate curvature of the edges 220, 222 of the snowboard 200. In some embodiments, a forward portion of each of the side protrusions 204, 206 can be curved so as to match the approximate curvature of the edges 220, 222 of the snowboard 200, while a rearward portion of each of the side protrusions 204, 206 can be approximately linear. Curving the protrusions 204, 206 can improve the directional stability of the snowboard 200 and can help a user initiate a turn from a straight path.

Additionally, as illustrated, the side protrusions 204, 206 (or any other protrusion disclosed herein) can be discontinuous or can define cutouts 218 along the length thereof. The discontinuities or the cutouts 218 can be approximately flat and coplanar with the remainder of the bottom surface 210 of the snowboard so as to permit cross-flow of snow laterally across the bottom surface 210 of the snowboard 210. Additionally, in some embodiments, the discontinuities or cutouts 218 along the length of the side protrusions 204, 206 can result in additional forward surfaces 204A, 206A that can engage the snow surface and impede the forward motion of the snowboard, so as to provide additional longitudinal stability to the snowboard. In some embodiments, the length of the cutouts 218 can be approximately 1.5 in, or from approximately 1 in or less to approximately 3 in or more, or from approximately 1 in or less to approximately 2 in or more. The forward edges 204A, 206A can have a shape that is similar to any of the other forward edge shapes disclosed herein, including spherical, triangular, beveled, bullnose, or other suitable shapes. In some embodiments, the forward edge 204A, 206A of some portions of the side protrusions 204, 206 can vary along the length thereof.

The lead protrusion 202 can be configured so as to attenuate or damp the forward or lateral movement of the snowboard 200, particularly when a user presses down with his or her front foot on the forward portion of the snowboard 200 so as to exert a greater force or pressure on the center protrusion 202. Because the center protrusion 202 can be positioned such that all or a portion of the center protrusion 202 is in the forward portion of the snowboard 200, the effect of the center protrusion 202 can be increased and decreased by a user by altering the amount of weight or force that is exerted by a user's front foot and, hence, on the fore portion of the snowboard 200. Therefore, in some embodiments, the user can increase the damping effect that the lead protrusion 202 can exert on the lateral and/or longitudinal movement of the snowboard by varying the amount of weight that is exerted on the user's front foot. Additionally, because the lead protrusion 202 can be positioned closer to the nose portion 212 of the snowboard 200, the lead protrusion 202 can engage the snow surface at an advanced position as compared to the side protrusions 204, 206, so as to help engage the snow surface at an earlier point on the snowboard 200 as compared to the side protrusions 204, 206 and thus cause an earlier or more forward portion of the snowboard 200 to initiate a turn.

In some embodiments, the lead protrusion 202 and the side protrusions 204, 206 can be approximately straight (as illustrated) and can have a generally uniform cross-sections along the length thereof. In some embodiments, the lead protrusion 202 and/or the side protrusions 204, 206 can have a curved surface in a widthwise direction (i.e., along the length thereof). Additionally, the leading edges 202A, 204A, 206A of the protrusions 202, 204, 206 can be spherical, triangular, beveled, curved, tapered, rounded, or similarly shaped or configured. In some embodiments, the leading edges 202A, 204A, 206A of the protrusions 202, 204, 206 can have a generally flat angled surface. In some embodiments, the leading edges 202A, 204A, 206A of the protrusions 202, 204, 206 can each have a spherical shape. The rearward edges or portions 202B, 204B, 206B of the protrusions 202, 204, 206 can be similarly shaped.

In some embodiments, with reference to FIGS. 5-8, the length of the snowboard 210 can be approximately 61.25 in, the width of the snowboard at the nose portion 212 and tail portion 214 can be approximately 11.625 in, and the distance from the nose portion 212 to the inserts 230 can be approximately 19.375 in and can extend to approximately 23.875 in from the nose portion 212. The nose portion 212 of the snowboard 200 or of any other snowboard disclosed herein can rise to the distance approximately 2.5 in, or from approximately 2 in to approximately 3 in above the bottom surface of the snowboard. Similarly, the tail portion of 14 of the snowboard 200 or any other snowboard disclosed herein can rise to a distance approximately 2.5 in, or from approximately 2 in to approximately 3 in above the bottom surface of the snowboard. These dimensions and the dimensional ranges disclosed herein are merely exemplifying and are not meant to indicate required or even preferable dimensions or dimensional ranges of the snowboards that are suitable for such longitudinal protrusions.

In some embodiments, the length of the center protrusion 202 can be approximately 8.5 in, or from approximately 6 in or less to approximately 14 in or more. In some embodiments, the center protrusion 202 can be positioned on the snowboard 210 such that the distance L202A from the nose 212 of the snowboard 210 to the leading edge 202A can be approximately 17.75 in, or from approximately 12 in or less to approximately 24 in or more, or from approximately 16 in or less to approximately 20 in or more.

Further, the distance from the rear portion 214 to the inserts 232 can be approximately 16.625 in and can extend to approximately 21.25 in from the rear portion 214. In some embodiments, the length of the side protrusions 204, 206 can be approximately 30.5 in, or from approximately 20 in or less to approximately 35 in or more, or from approximately 25 in to approximately 32 in. In some embodiments, the side protrusions 204, 206 can be positioned on the snowboard 210 such that the distance L204A from the nose 212 of the snowboard 210 to the leading edge 204A can be approximately 22 in, or from approximately 16 in or less to approximately 28 in or more, or from approximately 19 in or less to approximately 25 in or more.

In some embodiments, the side protrusions 204, 206 or any other side protrusions of any other snowboard disclosed herein can be positioned on the snowboard 210 such that the distance L204B from the rear portion 214 of the snowboard 210 to the rear edge 204B can be approximately 9 in, or from approximately 6 in or less to approximately 15 in or more, or from approximately 7 in or less to approximately 11 in or more. Terminating the side protrusions 204, 206 or any other side protrusions of any other snowboard disclosed herein a distance from the rearward portion 214 of the snowboard can provide a distance of the rearward portion of the snowboard that has unobstructed cross-flow characteristics (i.e., similar to that of a conventional base) behind the rear foot of the user to permit the user to slide to tail portion of the snowboard relative to the snow surface. Alternatively, in some embodiments (not illustrated), the side protrusions 204, 206 or any other side protrusions of any other snowboard disclosed herein can be configured to terminate beneath the rear foot of the user such that a user can apply force to the side protrusions by exerting weight or force on the user's front or rear foot.

In some embodiments, the side protrusions 204, 206 can be positioned such that the centerline of the side protrusions 204, 206 can be at least approximately 1.9 in from the side edges 220, 222 of the snowboard. In some embodiments, the side protrusions 204, 206 can be positioned such that the centerline of the side protrusions 204, 206 can be at least from approximately 1.0 in to approximately 2.5 in, or from approximately 1.5 to approximately 2.1 in from the side edges of the snowboard.

The width of each of the protrusions 202, 204, 206 or any other protrusions disclosed herein can be approximately 0.75 in., or from approximately 0.25 in or less to approximately 1.25 in or more, or from approximately 0.5 in or less to approximately 1.0 in or more. In some embodiments, the width of each of the protrusions 202, 204, 206 or any other protrusions disclosed herein can vary along the length of the protrusions through in some embodiments, with the protrusions at the forward portions of the protrusions can be smaller than the width of the protrusions at the center or at the trailing portions of the protrusions.

In some embodiments, the profile thickness (i.e., the extent to which the longitudinal protrusion projects away from the bottom surface 210 of the snowboard 200 or any other snowboard herein) of the longitudinal protrusions 202, 204, 206 or any other longitudinal protrusions disclosed herein can be approximately 0.125 in. In some embodiments, the profile thickness of any of the longitudinal protrusions disclosed herein can be from approximately 0.075 in or less to approximately 0.250 in or more, or from approximately 0.100 in or less to approximately 0.15 in or more.

Note that the dimensions and the dimensional ranges disclosed herein are merely exemplifying and are not meant to indicate required dimensions or dimensional ranges or limitations to the inventions. None of the exemplifying dimensions or dimensional ranges disclosed in this application is required. The dimensions of each of the protrusions 202, 204, 206 or any other protrusions disclosed herein can be any suitable value and each of the protrusions 202, 204, 206 or any other protrusions disclosed herein can be positioned at any suitable position on the snowboard. Further, the length and width of each of the protrusions as well as the longitudinal and lateral positioning of each of the protrusions can be dependent on the dimensions of the snowboard to which the protrusions are affixed, positioned, or formed on. Therefore, for example, without limitation, for snowboards having longer nose or forward portions, the protrusions may be positioned further from the nose portion of the snowboard and, hence, closer to the tail portion of the snowboard and/or may be shorter in length.

Figure 9:
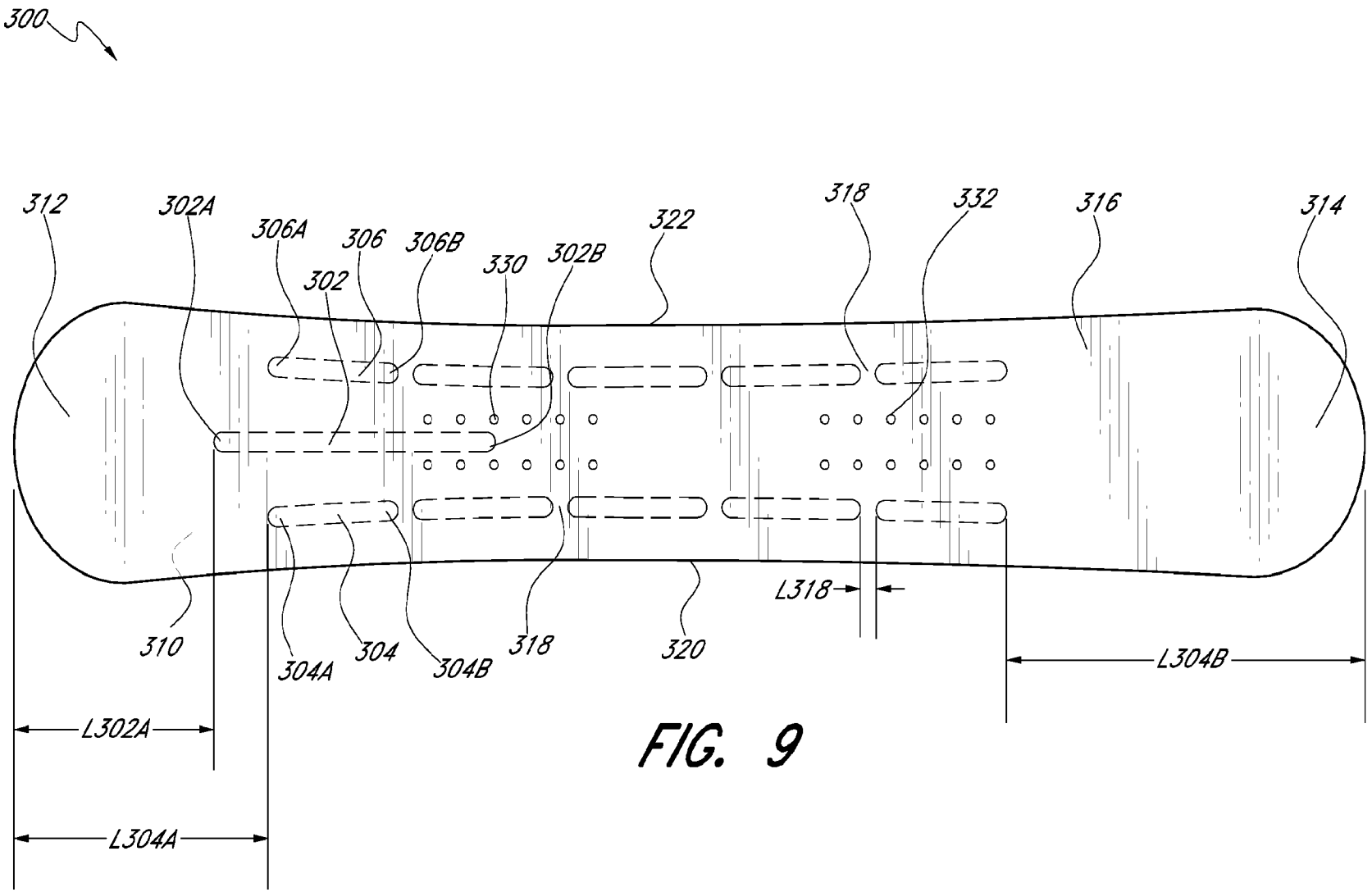
FIG. 9 is a top view of another embodiment of a snowboard showing generally lengthwise protrusions formed or positioned on the bottom surface of the snowboard in dashed lines for reference.
Figure 10:
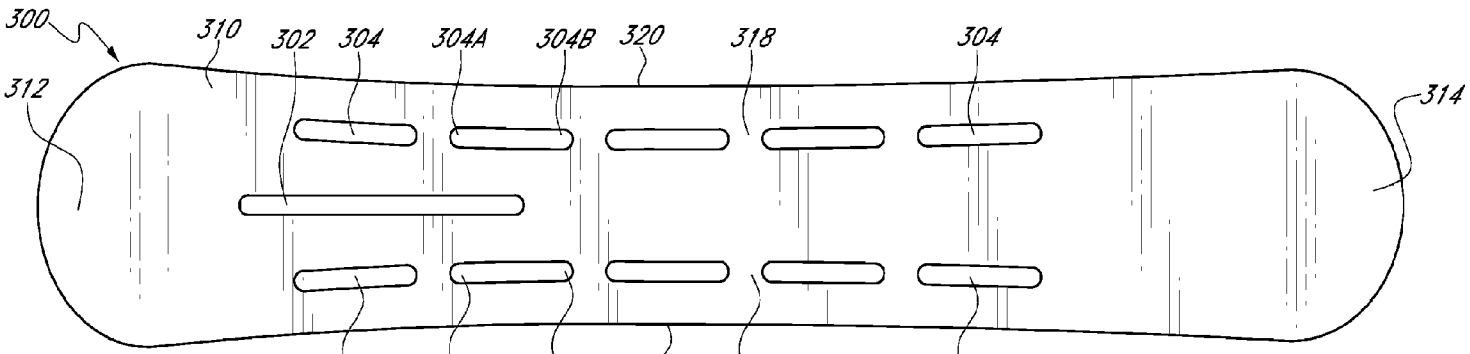
FIG. 10 is a bottom view of the embodiment of the snowboard shown in FIG. 9.
Figure 11:
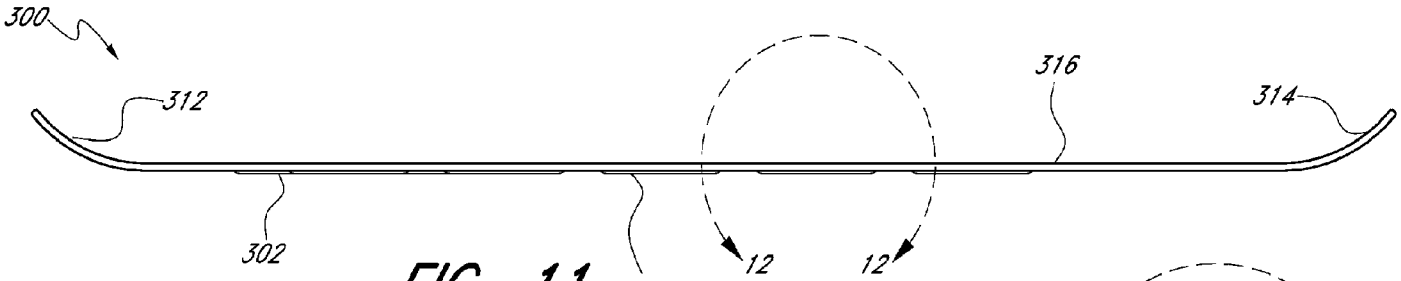
FIG. 11 is a side view of the embodiment of the snowboard shown in FIG. 9.
Figure 12:
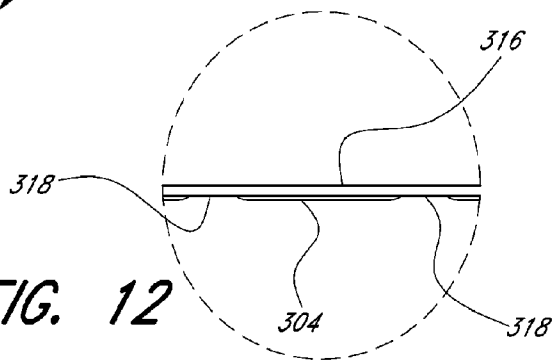
FIG. 12 is an enlarged side view of a portion of the embodiment of the snowboard shown in FIG. 9, defined by curve 12-12 in FIG. 11.

FIG. 9 is a top view of an embodiment of a snowboard 300 showing longitudinal protrusions 302, 304, 306 formed or positioned on a bottom surface 310 of the snowboard 300 in dashed lines for reference. In some embodiments (not illustrated), the snowboard 300 can be formed without the longitudinal protrusion 302, while having any of the other features, components, or details of any of the other embodiments disclosed herein. FIG. 10 is a bottom view of the embodiment of the snowboard 300 shown in FIG. 9, and FIGS. 11 and 12 are, respectively, a side view of the embodiment of the snowboard shown in FIG. 9 and an enlarged side view of a portion of the embodiment of the snowboard shown in FIG. 9, defined by curve 12-12 in FIG. 11. As with any of the embodiments of snowboards disclosed herein, the snowboard 300 can have an upwardly curved nose or tip portion 312 (also referred to herein as a fore portion), an upwardly curved tail portion 314 (also referred to herein as a rear or rearward portion), a top surface 316, and side surfaces or edges 320, 322. Additionally, the snowboard 300 including the longitudinal protrusions 302, 304, 306 can have any of the dimensions, shapes, features, or other details of any of the other snowboards or longitudinal protrusions disclosed herein.

In some embodiments, the snowboard 300 or any other embodiments of snowboards disclosed herein can have an upwardly curved or so-called reverse cambered bottom surface. Alternatively, in some embodiments, the snowboard 300 or any other embodiments of snowboards disclosed herein can have a flat bottom surface or a conventionally curved bottom surface.

Similar to snowboard 100, in some embodiments, threaded inserts 330 (which can be metal) can be supported in the snowboard 300 so as to form a plurality of the openings through the top surface 316 of the snowboard 300 in the middle and/or forward portion of the snowboard 300 so as to threadingly receive bolts from bindings that can be configured to support a user's rear foot. Alternatively, the top surface 316 of the snowboard can be configured such that a user can stand on the snowboard 300 without the use of bindings or such that a binding can be supported by the snowboard in an alternative manner. In such embodiments, the Velcro, grip tape, or other gripping features can be applied to the top surface 316 of the snowboard 300 to enhance the user's traction on the snowboard 300.

In some embodiments, as illustrated, the leading longitudinal protrusion 302 can be positioned in the lateral center of the snowboard 300, and can be positioned such that the forward portion 302A of the protrusion 302 is closer to the nose 312 of the snowboard 300 than the forward portions 304A, 306A of the side protrusions 304, 306. In any of the embodiments of the snowboards disclosed herein, the center protrusion 302 can be positioned such that all or a portion of the center protrusion 302 is positioned in a forward half of the snowboard. Additionally, in any of the embodiments of the snowboards disclosed herein, the center protrusion 302 can be positioned such that all or a portion of the center protrusion 302 is positioned below or adjacent to the threaded inserts 330 designed to accommodate a user's front foot, or otherwise configured so that all or a portion of the center protrusion 302 can be positioned beneath a user's front foot.

In any of the embodiments of the snowboards disclosed herein, two or more parallel oriented longitudinal protrusions 302 can be positioned symmetrically offset from the lateral center C1 of the snowboard 300. The longitudinal protrusion or protrusions 302 can each define a width of approximately 0.75 in, or from approximately 0.375 in or less to approximately 1.125 in or more. Additionally, in any of the embodiments of the snowboards disclosed herein, the profile of the leading longitudinal protrusions can be different than the profile of the rearward portion of the longitudinal protrusions.

As illustrated, the side protrusions 304, 306 can be symmetrically positioned so as to be offset from the longitudinal centerline C1. In some embodiments, the side protrusions 304, 306 can be sized and positioned such that the leading edges 304A, 306A of the protrusions 304, 306 are positioned in the forward half of the snowboard 300. In some embodiments, the side protrusions 304, 306 can be sized and positioned such that the leading edges 304A, 306A of the protrusions 304, 306 overlap or extended forward of the rearward edge or edges 302B of the center protrusion or protrusions 302. However, in some embodiments, the side protrusions 304, 306 can be sized and positioned such that the leading edges 304A, 306A of the protrusions 304, 306 are spaced apart from the rearward edge or edges 302B of the center protrusion or protrusions 302 so that a significant space or cross-flow channel is created between the center protrusion or protrusions and the side protrusions 304, 306.

In some embodiments, the side protrusions 304, 306 can be sized and positioned such that the leading edges 304A, 306A of the protrusions 304, 306 are positioned adjacent to at least some of the inserts 330 at the fore portion of the snowboard, such that a user's front foot can be positioned over the fore portions 304A, 306A of the protrusions 304, 306. The side protrusions 304, 306 can extend toward the tail portion 314 of the snowboard. In some embodiments, as in the illustrated embodiment, the protrusions 304, 306 can be sized and positioned such that the rearmost portions 304B, 306B of the side protrusions 304, 306 are positioned approximately adjacent to the threaded inserts 332 that are configured to support a user's rear foot, such that the rearmost portions 304B, 306B of the side protrusions 304, 306 can be positioned approximately under at least a portion of a user's rear foot. In some embodiments, where the side protrusions 304, 306 define approximately uniform cross-sections along the length thereof, terminating the side protrusions 304, 306 under a user's rear foot can result in a significant length of the rear portion of the snowboard that is free of the protrusions so as to increase a user's ability to slide or laterally move the tail portion 314 of the snowboard when needed.

In some embodiments, as illustrated, the protrusions 302, 304, 306 can be straight. In some embodiments, as in the illustrated embodiment, at least a portion of the side protrusions 304, 306 can be curved, angled, or otherwise nonlinear. For example, in some embodiments, each of the side protrusions 304, 306 can be curved so as to match the approximate curvature of the edges 320, 322 of the snowboard 300. In some embodiments, a forward portion of each of the side protrusions 304, 306 can be curved so as to match the approximate curvature of the edges 320, 322 of the snowboard 300, while a rearward portion of each of the side protrusions 304, 306 can be approximately linear. Curving the protrusions 304, 306 can improve the directional stability of the snowboard 300 and can help a user initiate a turn from a straight path.

Additionally, as illustrated, any of the protrusions 302, 304, 306 can be discontinuous or can define cutouts 318 along the length thereof. The discontinuities or the cutouts 318 can be approximately flat and coplanar with the remainder of the bottom surface 310 of the snowboard so as to permit cross-flow of snow laterally across the bottom surface 310 of the snowboard 310. Additionally, in some embodiments, the discontinuities or cutouts 318 along the length of the side protrusions 304, 306 can result in additional forward surfaces 304A, 306A that can engage the snow surface and impede the forward motion of the snowboard, so as to provide additional longitudinal stability to the snowboard. In some embodiments, the length of the cutouts 318 can be approximately 1.5 in, or from approximately 1 in or less to approximately 3 in or more, or from approximately 1 in or less to approximately 2 in or more. The forward edges 302A, 304A, 304B can have a shape that is similar to any of the other forward edge shapes disclosed herein, including spherical, triangular, beveled, bullnose, or other suitable shapes. In some embodiments, the forward edge 302A, 304A, 306A of some portions of the protrusions 302, 304, 306 can vary along the length thereof.

The lead protrusion 302 can be configured so as to attenuate or damp the forward or lateral movement of the snowboard 300, particularly when a user presses down with his or her front foot on the forward portion of the snowboard 300 so as to exert a greater force or pressure on the center protrusion 302. Because the center protrusion 302 can be positioned such that all or a portion of the center protrusion 302 is in the forward portion of the snowboard 300, the effect of the center protrusion 302 can be increased and decreased by a user by altering the amount of weight or force that is exerted by a user's front foot and, hence, on the fore portion of the snowboard 300. Therefore, in some embodiments, the user can increase the damping effect that the lead protrusion 302 can exert on the lateral and/or longitudinal movement of the snowboard by varying the amount of weight that is exerted on the user's front foot. Additionally, because the lead protrusion 302 can be positioned closer to the nose portion 312 of the snowboard 300, the lead protrusion 302 can engage the snow surface at an advanced position as compared to the side protrusions 304, 306, so as to help engage the snow surface at an earlier point on the snowboard 300 as compared to the side protrusions 304, 306 and thus cause an earlier or more forward portion of the snowboard 300 to initiate a turn.

In some embodiments, the lead protrusion 302 can be approximately straight (as illustrated) and can have a generally uniform cross-sections along the length thereof. In some embodiments, as illustrated, the side protrusions 304, 306 can have a curved surface in a widthwise direction (i.e., along the length thereof) that can approximately match the curvature of the side edges 320, 322. Additionally, the leading edges 302A, 304A, 306A of the protrusions 302, 304, 306 can be spherical, triangular, beveled, curved, tapered, rounded, or similarly shaped or configured. In some embodiments, the leading edges 302A, 304A, 306A of the protrusions 302, 304, 306 can have a generally flat angled surface. In some embodiments, the leading edges 302A, 304A, 306A of the protrusions 302, 304, 306 can each have a spherical shape. The rearward edges or portions 302B, 304B, 306B of the protrusions 302, 304, 306 can be similarly shaped.

In some embodiments, with reference to FIGS. 9-12, the length of the snowboard 310 can be approximately 61.25 in, the width of the snowboard at the nose portion 312 and tail portion 314 can be approximately 11.625 in, and the distance from the nose portion 312 to the inserts 330 can be approximately 18.75 in and can extend to approximately 26.25 in from the nose portion 312. The nose portion 312 of the snowboard 300 or of any other snowboard disclosed herein can rise to the distance approximately 2.5 in, or from approximately 2 in to approximately 2.75 in above the bottom surface of the snowboard. Similarly, the tail portion of 14 of the snowboard 300 or any other snowboard disclosed herein can rise to a distance of approximately 2.5 in, or from approximately 2 in to approximately 2.75 in above the bottom surface of the snowboard. These dimensions and the dimensional ranges disclosed herein are merely exemplifying and are not meant to indicate required or even preferable dimensions or dimensional ranges of the snowboards that are suitable for such longitudinal protrusions.

In some embodiments, the length of the center protrusion 302 can be approximately 12.75 in, or from approximately 6 in or less to approximately 15 in or more, or from approximately 10 in or less to approximately 15 in or more. In some embodiments, the center protrusion 302 can be positioned on the snowboard 310 such that the distance L302A from the nose 312 of the snowboard 310 to the leading edge 302A can be approximately 9 in, or from approximately 5 in or less to approximately 17 in or more, or from approximately 7 in or less to approximately 11 in or more.

Further, the distance from the rear portion 314 to the inserts 332 can be approximately 17 in and can extend to approximately 24.5 in from the rear portion 314. In some embodiments, the length of the side protrusions 304, 306 can be approximately 33.25 in, or from approximately 15 in or less to approximately 40 in or more, or from approximately 25 in to approximately 35 in. In some embodiments, the side protrusions 304, 306 can be positioned on the snowboard 310 such that the distance L304A from the nose 312 of the snowboard 310 to the leading edge 304A can be approximately 11.75 in, or from approximately 8 in or less to approximately 22 in or more.

In some embodiments, the side protrusions 304, 306 or any other side protrusions of any other snowboard disclosed herein can be positioned on the snowboard 310 such that the distance L304B from the rear portion 314 of the snowboard 310 to the rear edge 304B can be approximately 16.25 in, or from approximately 13 in or less to approximately 22 in or more, or from approximately 15 in or less to approximately 18 in or more. As mentioned above, terminating the side protrusions 304, 306 or any other side protrusions of any other snowboard disclosed herein a distance from the rearward portion 314 of the snowboard can provide an increased distance of the rearward portion of the snowboard that has unobstructed cross-flow characteristics (i.e., similar to that of a conventional base) behind the rear foot of the user to permit the user to slide to tail portion of the snowboard relative to the snow surface. In some embodiments (not illustrated), the side protrusions 304, 306 or any other side protrusions of any other snowboard disclosed herein can be configured to terminate beneath the rear foot of the user such that a user can apply force to the side protrusions by exerting weight or force on the user's front or rear foot.

In some embodiments, the side protrusions 304, 306 can be positioned such that the centerline of the side protrusions 304, 306 can be at least approximately 1.6 in from the side edges 320, 322 of the snowboard. In some embodiments, the side protrusions 304, 306 can be positioned such that the centerline of the side protrusions 304, 306 can be at least from approximately 1.0 in to approximately 2.5 in, or from approximately 1.3 to approximately 2.1 in from the side edges of the snowboard.

The width of each of the protrusions 302, 304, 306 or any other protrusions disclosed herein can be approximately 0.75 in., or from approximately 0.25 in or less to approximately 1.25 in or more, or from approximately 0.5 in or less to approximately 1.0 in or more. In some embodiments, the width of each of the protrusions 302, 304, 306 or any other protrusions disclosed herein can vary along the length of the protrusions through in some embodiments, with the protrusions at the forward portions of the protrusions can be smaller than the width of the protrusions at the center or at the trailing portions of the protrusions.

In some embodiments, the profile thickness (i.e., the extent to which the longitudinal protrusion projects away from the bottom surface 310 of the snowboard 300 or any other snowboard herein) of the longitudinal protrusions 302, 304, 306 or any other longitudinal protrusions disclosed herein can be approximately 0.125 in. In some embodiments, the profile thickness of any of the longitudinal protrusions disclosed herein can be from approximately 0.075 in or less to approximately 0.250 in or more, or from approximately 0.100 in or less to approximately 0.15 in or more.

Note that the dimensions and the dimensional ranges disclosed herein are merely exemplifying and are not meant to indicate required dimensions or dimensional ranges or limitations to the inventions. None of the exemplifying dimensions or dimensional ranges disclosed in this application is required. The dimensions of each of the protrusions 302, 304, 306 or any other protrusions disclosed herein can be any suitable value and each of the protrusions 302, 304, 306 or any other protrusions disclosed herein can be positioned at any suitable position on the snowboard. Further, the length and width of each of the protrusions as well as the longitudinal and lateral positioning of each of the protrusions can be dependent on the dimensions of the snowboard to which the protrusions are affixed, positioned, or formed on. Therefore, for example, without limitation, for snowboards having longer nose or forward portions, the protrusions may be positioned further from the nose portion of the snowboard and, hence, closer to the tail portion of the snowboard and/or may be shorter in length.

Figure 13:
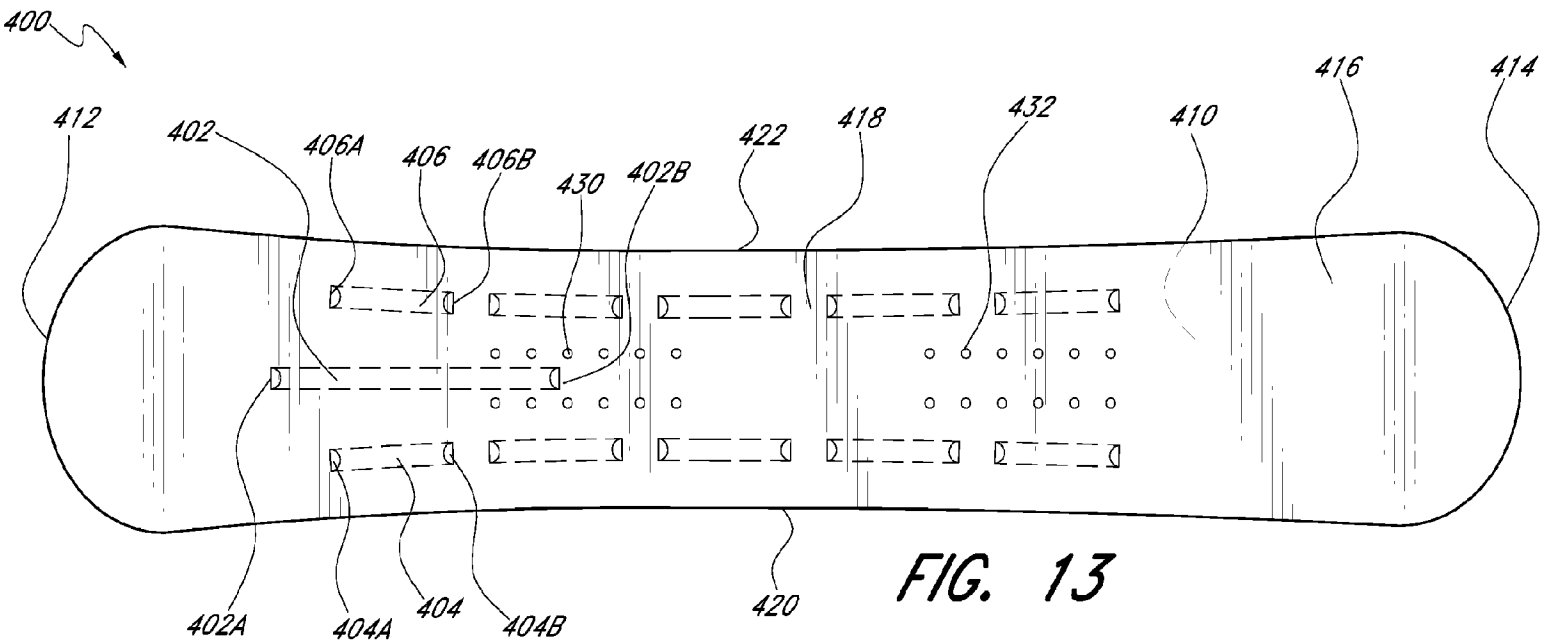
FIG. 13 is a bottom view of another embodiment of a snowboard showing generally lengthwise protrusions formed or positioned on a bottom surface of the snowboard.
Figure 14:
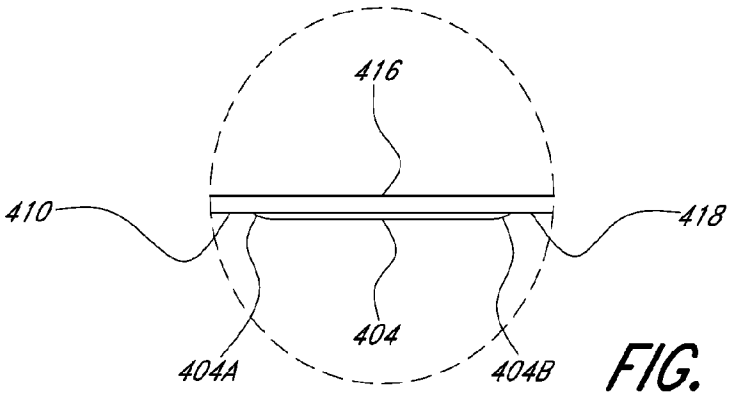
FIG. 14 is a side view of a portion of the embodiment of the snowboard illustrated in FIG. 13.

FIG. 13 is a top view of an embodiment of a snowboard 400 showing longitudinal protrusions 402, 404, 406 formed or positioned on a bottom surface 410 of the snowboard 400 in dashed lines for reference. FIG. 14 is a side view of a portion of the embodiment of the snowboard 400 illustrated in FIG. 13. As with any of the embodiments of snowboards disclosed herein, the snowboard 400 can have an upwardly curved nose or tip portion 412 (also referred to herein as a fore portion), an upwardly curved tail portion 414 (also referred to herein as a rear or rearward portion), a top surface 416, and side surfaces or edges 420, 422. Additionally, the snowboard 400 including the longitudinal protrusions 402, 404, 406 can have any of the dimensions, shapes, features, or other details of any of the other snowboards or longitudinal protrusions disclosed herein.

In some embodiments, the snowboard 400 can have any of the features of the embodiment of the snowboard 300 described above, or any other embodiment disclosed herein, in addition to or in the alternative to as follows. The snowboard 400 can be configured such that the side protrusions 404, 406 are curved along the forward portion thereof or straight but arranged in a curved pattern, but straight along a rearward portion thereof. For example, the side protrusions 404, 406 can be configured such that the first two segments of the side protrusions 404, 406 (i.e., those positioned closest to the tip 412 of the snowboard) are curved or aligned along a curved path, and the final two segments of the side protrusions 404, 406 (i.e., those positioned closest to the rear 414 of the snowboard are straight or arranged along a linear path.

Additionally, in some embodiments, as illustrated most clearly in FIG. 14, the side protrusions 402, 404, 406 can be configured such that the forward portions 402A, 404A, 406A and/or the rearward portions 402B, 404B, 406B of the longitudinal protrusions comprise beveled or sloped surfaces. In some embodiments, as in the illustrated embodiment, the surfaces of the forward portions 402A, 404A, 406A and/or the rearward portions 402B, 404B, 406B can be approximately planar but angled so at to transition from the bottom surface 410 of the snowboard 400 to the thickness of the protrusions 402, 404, 406.

Figure 15:
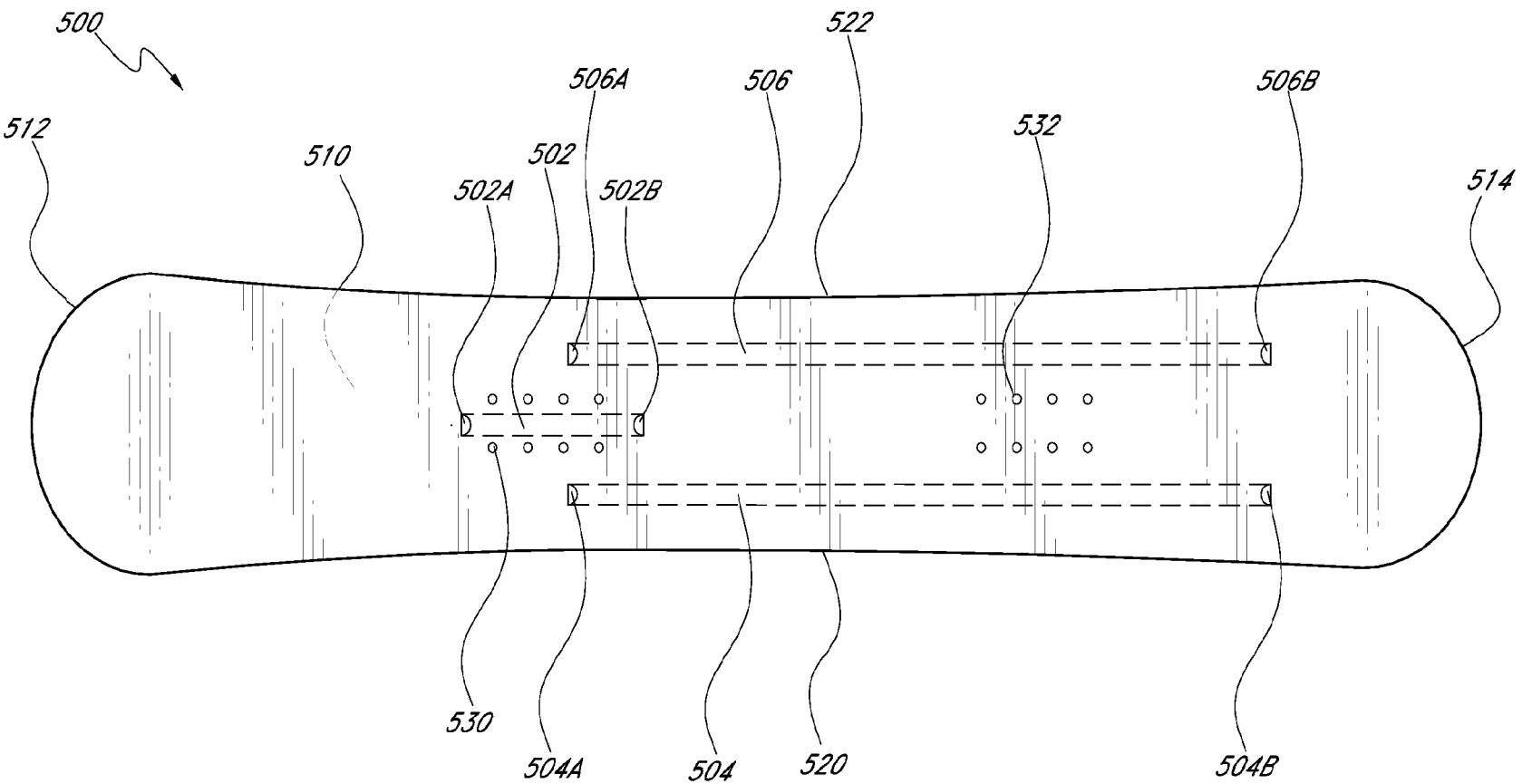
FIG. 15 is a top view of another embodiment of a snowboard showing generally lengthwise protrusions formed or positioned on a bottom surface of the snowboard in dashed lines for reference.
Figure 16:
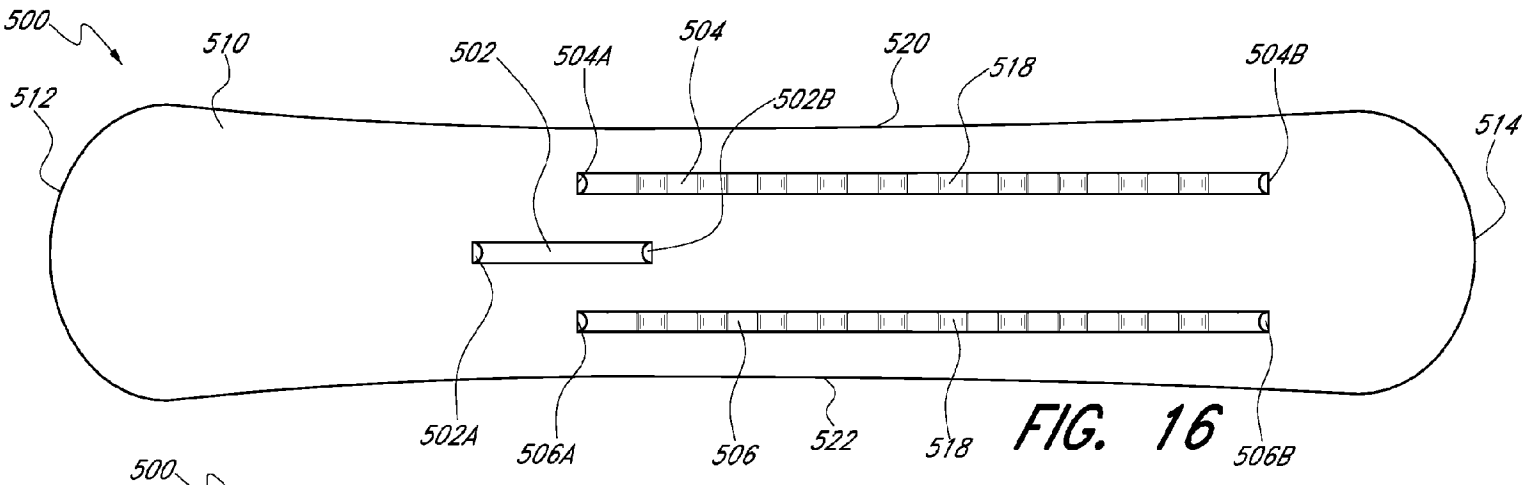
FIG. 16 is a bottom view of the embodiment of the snowboard shown in FIG. 15.
Figure 17:
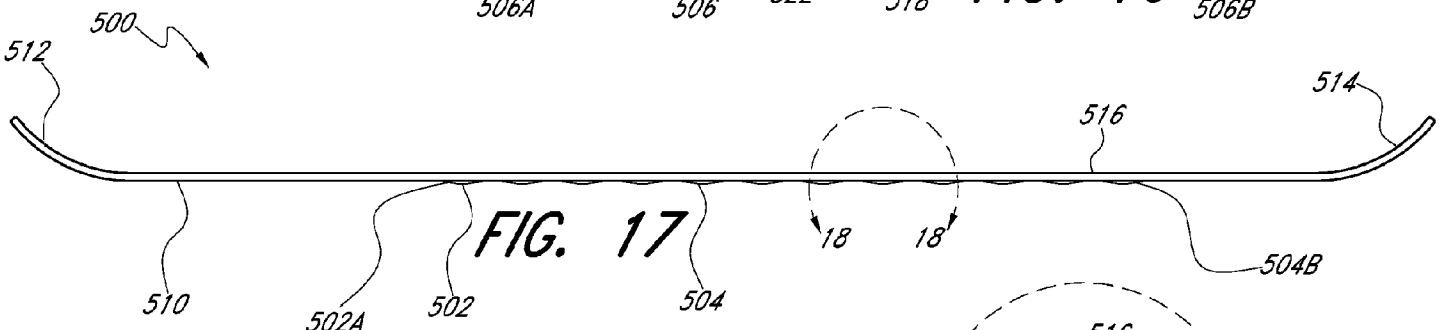
FIG. 17 is a side view of the embodiment of the snowboard shown in FIG. 15.
Figure 18:
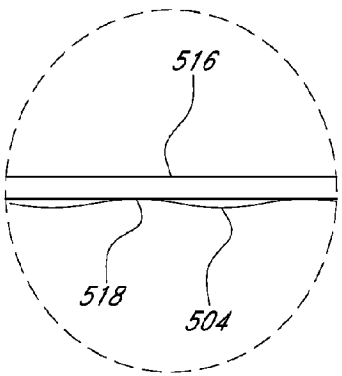
FIG. 18 is an enlarged side view of a portion of the embodiment of the snowboard shown in FIG. 15, defined by curve 18-18 in FIG. 17.

FIG. 15 is a top view of another embodiment of a snowboard 500 showing longitudinal protrusions 502, 504, 506 formed or positioned on a bottom surface of the snowboard 500 in dashed lines for reference. FIG. 16 is a bottom view of the embodiment of the snowboard 500 shown in FIG. 15. FIG. 17 is a side view of the embodiment of the snowboard 500 shown in FIG. 15, and FIG. 18 is an enlarged side view of a portion of the embodiment of the snowboard 500 shown in FIG. 15, defined by curve 18-18 in FIG. 17.

As with any of the embodiments of snowboards disclosed herein, the snowboard 500 can have an upwardly curved nose or tip portion 512 (also referred to herein as a fore portion), an upwardly curved tail portion 514 (also referred to herein as a rear or rearward portion), a top surface 516, and side surfaces or edges 520, 522. Additionally, the snowboard 500 including the longitudinal protrusions 502, 504, 506 can have any of the dimensions, shapes, features, or other details of any of the other snowboards or longitudinal protrusions disclosed herein.

In some embodiments, the snowboard 500 can have any of the features of either the embodiments of the snowboards 300, 400 described above, or any other embodiment disclosed herein, in addition to or in the alternative to as follows. The snowboard 500 can be configured such that the side protrusions 504, 506 and/or center protrusion 502 can define an undulating or otherwise non-uniform profile along the length of the protrusions so that, without limitation, portions of the protrusions extend further away from the bottom surface of the base than other portions of the protrusions. As such, the side protrusions 504, 506 and/or center protrusion 502 can define depressions 518 along the length thereof that can be uniform along the length thereof, or can vary in depth or length along the length thereof.

For example, without limitation, the depressions 518 can be shallower (i.e., less pronounced) in the fore portion of the side protrusions 504, 506 and/or center protrusion 502, and deeper (i.e., more pronounced) in the aft portion of the side protrusions 504, 506 and/or center protrusion 502. In some embodiments, the depressions 518 can be deeper in the fore portion of the side protrusions 504, 506 and/or center protrusion 502, and shallower in the aft portion of the side protrusions 504, 506 and/or center protrusion 502, or can define any suitable pattern along the length of the side protrusions 504, 506 and/or center protrusion 502. In some embodiments, the depressions 518 can be the same thickness (e.g., 0.125 in) as the side protrusions 504, 506 and/or center protrusion 502 so that the depressions 518 are flush with the bottom surface 510 of the snowboard.

The peaks and depressions of the side protrusions 504, 506 and/or center protrusion 502 can be sinusoidally or wave-like shaped, can be square or rectangular shaped in profile, trapezoid shaped in profile, triangular shaped in profile, or can define any other suitable shape. The side protrusions 504, 506 and/or center protrusion 502 can be straight or curved along the length thereof, or can be curved along the forward portion thereof, but straight along a rearward portion thereof or vice versa.

Additionally, in some embodiments, the side protrusions 502, 504, 506 can be configured such that the forward portions 502A, 504A, 506A and/or the rearward portions 502B, 504B, 506B of the longitudinal protrusions comprise beveled or sloped surfaces. In some embodiments, as in the illustrated embodiment, the surfaces of the forward portions 502A, 504A, 506A and/or the rearward portions 502B, 504B, 506B can be approximately planar but angled so at to transition from the bottom surface 510 of the snowboard 500 to the thickness of the protrusions 502, 504, 506.

Figure 19B:
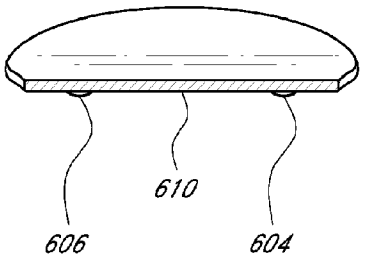
FIG. 19B is a section view of the embodiment of the snowboard shown in FIG. 19 taken through line 19B-19B in FIG. 1.
Figure 19A:
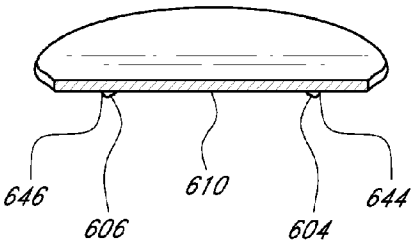
FIG. 19A is a section view of the embodiment of the snowboard shown in FIG. 19 taken through line 19A-19A in FIG. 1.

FIG. 19 is a top view of another embodiment of a snowboard 600 showing side longitudinal protrusions 604, 606 formed or positioned on a bottom surface of the snowboard 600 in dashed lines for reference. With reference to FIG. 19, some embodiments of the snowboard 600 can be configured to have two longitudinal protrusions formed or positioned on the base of the snowboard, for example, the side protrusions 604, 606. FIGS. 19A and 19B are section views of the embodiment of the snowboard 600 shown in FIG. 19 taken through line 19A-19A and line 19B-19B, respectively, in FIG. 1. FIGS. 20 and 21 are a bottom view and a side view, respectively, of the embodiment of the snowboard 600 shown in FIG. 19.

As with any of the embodiments of snowboards disclosed herein, the snowboard 600 can an upwardly curved nose or tip or fore portion 612, an upwardly curved tail or rear portion 614, a top surface 616, and side surfaces or edges 620, 622. Additionally, the snowboard 600 including the longitudinal protrusions 604, 606 can have any of the dimensions, shapes, features, or other details of any of the other snowboards or longitudinal protrusions disclosed herein.

In some embodiments, the snowboard 600 can have any of the features of either the embodiments of the snowboards 100, 200, 300, 400, 500 described above, or any other embodiment disclosed herein, in addition to or in the alternative to as follows. With reference to the FIGS. 19-21, some embodiments of the snowboard 600 can be configured such that the side protrusions 604, 606 can each define a cutout 644, 646, respectively, in a side surface of a forward portion of each of the side protrusion 604, 606. In some embodiments, as in the illustrated embodiment, the cutouts 644, 646 can be formed in the outside surface of the protrusions 604, 606. The cutouts 644, 646 can increase the engagement of the fore portions of the side protrusions 604, 606 to help initiate a turn with the snowboard 600. Some embodiments (not illustrated) of the snowboard 600 can have cutouts 644, 646, respectively, in both the inside and outside side surface of a forward portion of each of the side protrusion 604, 606.

In some embodiments, the length of the cutouts or cut portions 644, 646 can be approximately 6 in from the fore surface 604A, 606A of each of the side protrusions 604, 606. In some embodiments, the length of the cutouts or cut portions 644, 646 can be from approximately 4 in or less to approximately 12 in or more, or from approximately 5 in to approximately 8 in from the fore surface 604A, 606A of each of the side protrusions 604, 606. In some embodiments, the length of the cutouts or cut portions 644, 646 can be approximately 20% of the length of each of the side protrusions 604, 606, or from approximately 10% or less to approximately 40% or more, or from approximately 15% to approximately 30% of the length of each of the side protrusions 604, 606. In some embodiments, the cutouts 644, 646 can extend along the entire length, or substantially the entire length of the side protrusions 604, 606, respectively.

Figure 22:
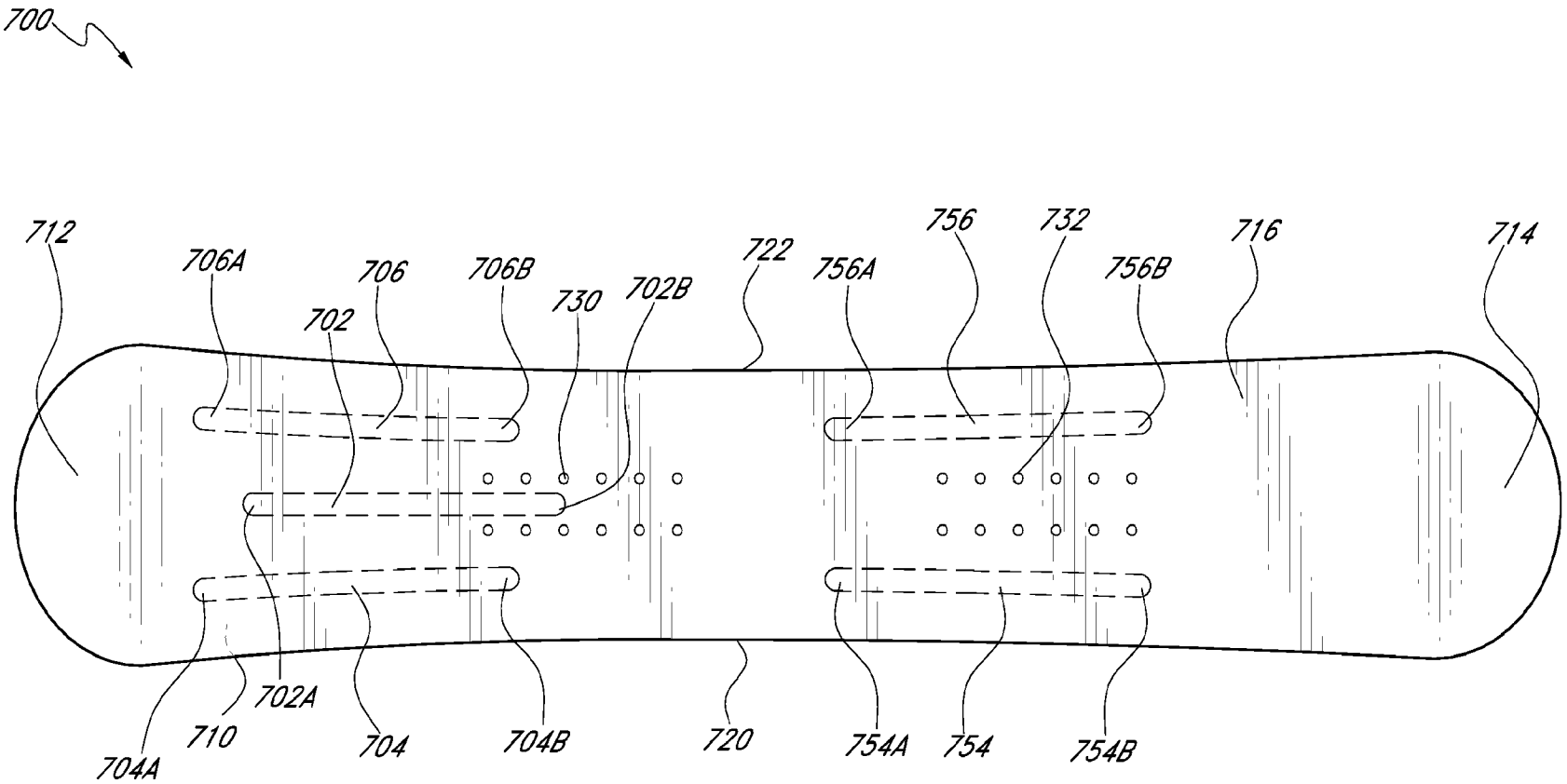
FIG. 22 is a top view of another embodiment of a snowboard showing generally lengthwise protrusions formed or positioned on a forward half of the bottom surface of the snowboard in dashed lines for reference.

FIG. 22 is a top view of an embodiment of a snowboard 700 showing longitudinal protrusions 702, 704, 706 formed or positioned on a forward half of the bottom surface 710 of the snowboard 700 in dashed lines for reference. As illustrated, in some embodiments, the snowboard 700 can also have additional longitudinal protrusions 754, 756 formed or positioned on a rearward half of the snowboard 700. In some embodiments (not illustrated), the snowboard 700 can be formed without the centermost longitudinal protrusion 702, while having any of the other features, components, or details of any of the other embodiments disclosed herein.

As with any of the embodiments of snowboards disclosed herein, the snowboard 700 can have an upwardly curved nose or tip portion 712 (also referred to herein as a fore portion), an upwardly curved tail portion 714 (also referred to herein as a rear or rearward portion), a top surface 716, and side surfaces or edges 720, 722. Additionally, the snowboard 700 including the longitudinal protrusions 702, 704, 706, 754, 756 can have any of the dimensions, shapes, features, or other details of any of the other snowboards or longitudinal protrusions disclosed herein.

In some embodiments, the snowboard 700 or any other embodiments of snowboards disclosed herein can have an upwardly curved or so-called reverse cambered bottom surface. Alternatively, in some embodiments, the snowboard 700 or any other embodiments of snowboards disclosed herein can have a flat bottom surface or a conventionally curved bottom surface.

Similar to snowboard 100, in some embodiments, threaded inserts 730 (which can be metal) can be supported in the snowboard 700 so as to form a plurality of the openings through the top surface 716 of the snowboard 700 in the middle and/or forward portion of the snowboard 700 so as to threadingly receive bolts from bindings that can be configured to support a user's rear foot. Alternatively, the top surface 716 of the snowboard can be configured such that a user can stand on the snowboard 700 without the use of bindings or such that a binding can be supported by the snowboard in an alternative manner. In such embodiments, the Velcro, grip tape, or other gripping features can be applied to the top surface 716 of the snowboard 700 to enhance the user's traction on the snowboard 700.

In some embodiments, as illustrated, the leading longitudinal protrusion 702 can be positioned in the lateral center of the snowboard 700. As illustrated, in some embodiments, the foremost side protrusions 704, 706 can be positioned such that the forward portion 704A, 706A of the protrusion 702 are closer to the nose 712 of the snowboard 700 than the forward portion 702A of the center protrusion 702. In any of the embodiments of the snowboards disclosed herein, the center protrusion 702 can be positioned such that all or a portion of the center protrusion 702 is positioned in a forward half of the snowboard. Additionally, in any of the embodiments of the snowboards disclosed herein, the center protrusion 702 can be positioned such that all or a portion of the center protrusion 702 is positioned below or adjacent to the threaded inserts 730 designed to accommodate a user's front foot, or otherwise configured so that all or a portion of the center protrusion 702 can be positioned beneath a user's front foot.

In any of the embodiments of the snowboards disclosed herein, two or more parallel oriented longitudinal protrusions 702 can be positioned symmetrically offset from the lateral center C1 of the snowboard 700. The longitudinal protrusion or protrusions 702 can each define a width of approximately 0.75 in, or from approximately 0.375 in or less to approximately 1.125 in or more. Additionally, in any of the embodiments of the snowboards disclosed herein, the profile of the leading longitudinal protrusions can be different than the profile of the rearward portion of the longitudinal protrusions.

As illustrated, the side protrusions 704, 706 can be symmetrically positioned so as to be offset from the longitudinal centerline C1. In some embodiments, the side protrusions 704, 706 can be sized and positioned such that the leading edges 704A, 706A of the protrusions 704, 706 are positioned in the forward half of the snowboard 700. Without limitation, the side protrusions 704, 706 can be positioned such that the leading edges 704A, 706A of the protrusions 704, 706 are positioned adjacent to, or near the beginning of the contact surface of the snowboard 700 (i.e., are positioned adjacent to, or near the point where the nose portion 712 curves away from the base portion of the snowboard 700.

In some embodiments, the side protrusions 704, 706 can be sized and positioned such that the rearward edges 704B, 706B of the protrusions 704, 706 are positioned adjacent to at least some of the inserts 730 at the fore portion of the snowboard, such that a user's front foot can be positioned over the rearward portions 704B, 706B of the protrusions 704, 706.

In some embodiments, the protrusions 702, 704, 706 can be straight. In some embodiments, as in the illustrated embodiment, at least a portion of the side protrusions 704, 706 can be curved, angled, or otherwise nonlinear. For example, in some embodiments, each of the side protrusions 704, 706 can be curved so as to match the approximate curvature of the edges 720, 722 of the snowboard 700. In some embodiments, a forward portion of each of the side protrusions 704, 706 can be curved so as to match the approximate curvature of the edges 720, 722 of the snowboard 700, while a rearward portion of each of the side protrusions 704, 706 can be approximately linear. Curving the protrusions 704, 706 can improve the directional stability of the snowboard 700 and can help a user initiate a turn from a straight path.

The rearmost side protrusions 754, 756 can be positioned or formed on the rearward half of the snowboard 700, and can extend toward the tail portion 714 of the snowboard. In some embodiments, as in the illustrated embodiment, the protrusions 754, 756 can be sized and positioned such that the rearmost portions 754B, 756B of the side protrusions 754, 756 are positioned approximately adjacent to the rearmost portion of the threaded inserts 732 that are configured to support a user's rear foot, such that the rearmost portions 754B, 756B of the side protrusions 754, 756 can be positioned approximately under at least a portion of a user's rear foot. In some embodiments, where the side protrusions 754, 756 define approximately uniform cross-sections along the length thereof, terminating the side protrusions 754, 756 under a user's rear foot can result in a significant length of the rear portion of the snowboard that is free of the protrusions so as to increase a user's ability to slide or laterally move the tail portion 714 of the snowboard when needed. In some embodiments, the rearmost side protrusions 754, 756 can extend to the rear of the rearward inserts 732.

The rearmost side protrusions 754, 756 can extend forward of the rearmost inserts 732 or foot position toward the front half of the snowboard 700. In some embodiments, the rearmost side protrusions 754, 756 can be positioned entirely in the rearward half of the snowboard 700. In some embodiments, the rearmost side protrusions 754, 756 can extend into the front half of the snowboard 700.

Additionally, in some embodiments, any of the protrusions 702, 704, 706, 754, 756 can be discontinuous or can define cutouts along the length thereof. The discontinuities or the cutouts can be approximately flat and coplanar with the remainder of the bottom surface 710 of the snowboard so as to permit cross-flow of snow laterally across the bottom surface 710 of the snowboard 710. Additionally, in some embodiments, the discontinuities or cutouts along the length of any of the protrusions 702, 704, 706, 754, 756 can result in additional forward surfaces 702A, 704A, 706A, 754A, 756A that can engage the snow surface and impede the forward motion of the snowboard, so as to provide additional longitudinal stability to the snowboard. In some embodiments, the length of the cutouts can be approximately 1.5 in, or from approximately 1 in or less to approximately 3 in or more, or from approximately 1 in or less to approximately 2 in or more. The forward edges 702A, 704A, 706A, 754A, 756A of any of the protrusions 702, 704, 706, 754, 756 can have a shape that is similar to any of the other forward edge shapes disclosed herein, including spherical, triangular, beveled, bullnose, or other suitable shapes. In some embodiments, the forward edge 702A, 704A, 706A, 754A, 756A of any of the protrusions 702, 704, 706, 754, 756 can vary along the length thereof.

The lead protrusions 702, 704, 706 can be configured so as to attenuate or damp the forward or lateral movement of the snowboard 700, particularly when a user presses down with his or her front foot on the forward portion of the snowboard 700 so as to exert a greater force or pressure on the protrusions 702, 704, 706. Because the protrusions 702, 704, 706 can be positioned such that all or a portion of the protrusions 702, 704, 706 are in the forward portion of the snowboard 700, the effect of the protrusions 702, 704, 706 can be increased and decreased by a user by altering the amount of weight or force that is exerted by a user's front foot and, hence, on the fore portion of the snowboard 700. Therefore, in some embodiments, the user can increase the damping effect that the protrusions 702, 704, 706 can exert on the lateral and/or longitudinal movement of the snowboard by varying the amount of weight that is exerted on the user's front foot. Additionally, because the protrusions 702, 704, 706 can be positioned closer to the nose portion 712 of the snowboard 700, the protrusions 702, 704, 706 can engage the snow surface at an advanced position as compared to the rearmost protrusions 754, 756 so as to help engage the snow surface at an earlier point on the snowboard 700 as compared to the rearmost protrusions 754, 756 and thus cause an earlier or more forward portion of the snowboard 700 to initiate a turn.

In some embodiments, the lead protrusion 702 can be approximately straight (as illustrated) and can have a generally uniform cross-sections along the length thereof. In some embodiments, as illustrated, the side protrusions 704, 706 can have a curved surface in a widthwise direction (i.e., along the length thereof) that can approximately match the curvature of the side edges 720, 722. The side protrusions 754, 756 can be generally straight (as illustrated), or can be curved. In some embodiments, the side protrusions 754, 756 can be curved so as to match the curvature of the side edges 720, 722 of the snowboard.

Additionally, the leading edges 702A, 704A, 706A of the protrusions 702, 704, 706 can be spherical, triangular, beveled, curved, tapered, rounded, or similarly shaped or configured. In some embodiments, the leading edges 702A, 704A, 706A, 754, 756A of the protrusions 702, 704, 706, 754, 756 can have a generally flat angled surface. In some embodiments, the leading edges 702A, 704A, 706A, 754, 756A of the protrusions 702, 704, 706, 754, 756 can each have a spherical shape. The rearward edges or portions 702B, 704B, 706B, 754B, 756B of the protrusions 702, 704, 706, 754, 756 can be similarly shaped.

Figure 23:
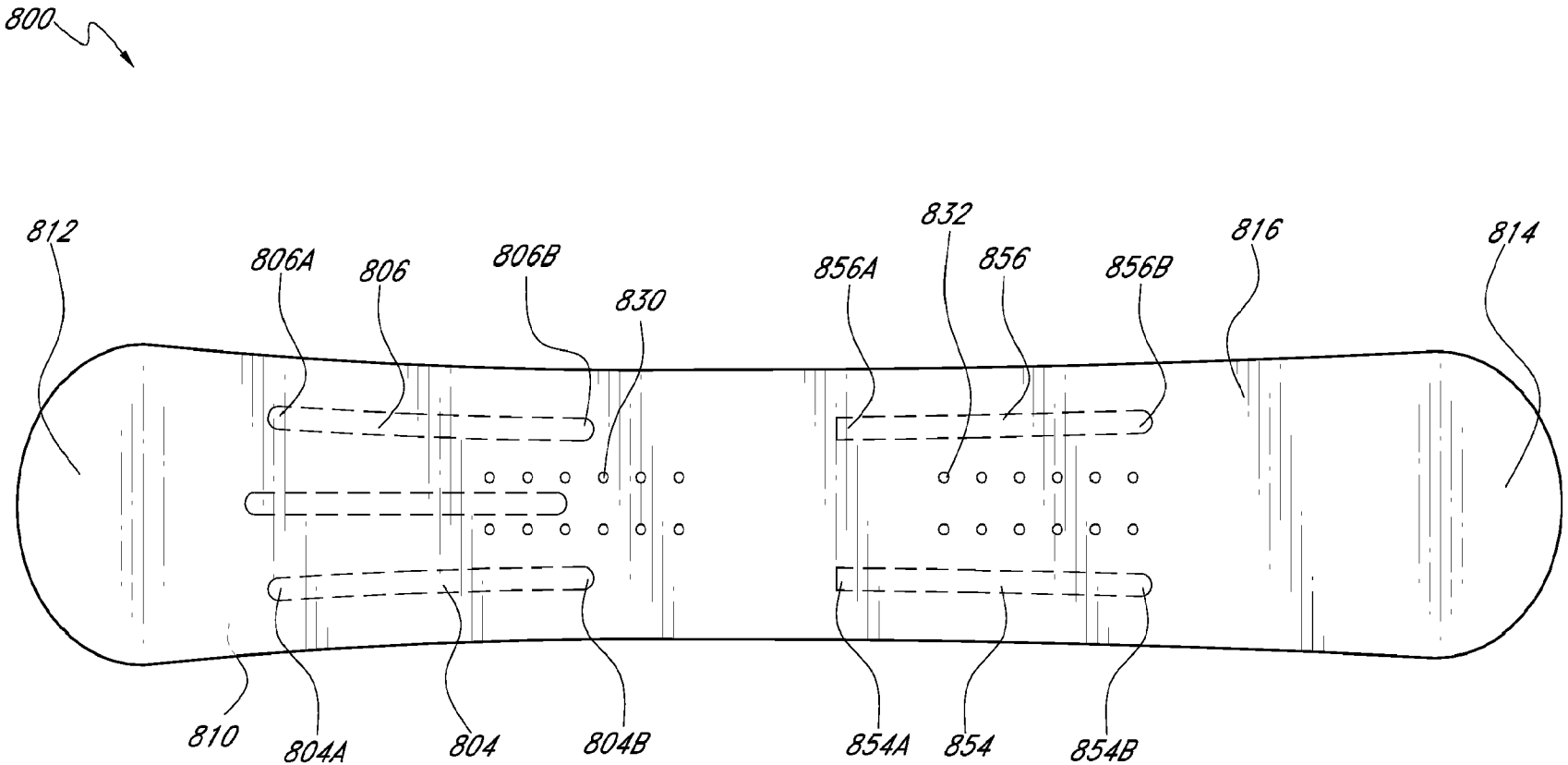
FIG. 23 is a top view of another embodiment of a snowboard showing generally lengthwise protrusions formed or positioned on a forward half of the bottom surface of the snowboard in dashed lines for reference.

FIG. 23 is a top view of an embodiment of a snowboard 800 showing longitudinal protrusions 802, 804, 806 formed or positioned on a forward half of the bottom surface 810 of the snowboard 800 in dashed lines for reference. As illustrated, in some embodiments, the snowboard 800 can also have additional longitudinal protrusions 854, 856 formed or positioned on a rearward half of the snowboard 800. In some embodiments (not illustrated), the snowboard 800 can be formed without the centermost longitudinal protrusion 802, while having any of the other features, components, or details of any of the other embodiments disclosed herein.

As with any of the embodiments of snowboards disclosed herein, the snowboard 800 can have an upwardly curved nose or tip portion 812 (also referred to herein as a fore portion), an upwardly curved tail portion 814 (also referred to herein as a rear or rearward portion), a top surface 816, and side surfaces or edges 820, 822. Additionally, the snowboard 800 including the longitudinal protrusions 802, 804, 806, 854, 856 can have any of the dimensions, shapes, features, or other details of any of the other snowboards or longitudinal protrusions disclosed herein.

In some embodiments, the snowboard 800 or any other embodiments of snowboards disclosed herein can have an upwardly curved or so-called reverse cambered bottom surface. Alternatively, in some embodiments, the snowboard 800 or any other embodiments of snowboards disclosed herein can have a flat bottom surface or a conventionally curved bottom surface.

Similar to snowboard 100, in some embodiments, threaded inserts 830 (which can be metal) can be supported in the snowboard 800 so as to form a plurality of the openings through the top surface 816 of the snowboard 800 in the middle and/or forward portion of the snowboard 800 so as to threadingly receive bolts from bindings that can be configured to support a user's rear foot. Alternatively, the top surface 816 of the snowboard can be configured such that a user can stand on the snowboard 800 without the use of bindings or such that a binding can be supported by the snowboard in an alternative manner. In such embodiments, the Velcro, grip tape, or other gripping features can be applied to the top surface 816 of the snowboard 800 to enhance the user's traction on the snowboard 800.

In some embodiments, as illustrated, the leading longitudinal protrusion 802 can be positioned in the lateral center of the snowboard 800. As illustrated, in some embodiments, the foremost side protrusions 804, 806 can be positioned such that the forward portion 804A, 806A of the protrusion 802 are closer to the nose 812 of the snowboard 800 than the forward portion 802A of the center protrusion 802. In any of the embodiments of the snowboards disclosed herein, the center protrusion 802 can be positioned such that all or a portion of the center protrusion 802 is positioned in a forward half of the snowboard. Additionally, in any of the embodiments of the snowboards disclosed herein, the center protrusion 802 can be positioned such that all or a portion of the center protrusion 802 is positioned below or adjacent to the threaded inserts 830 designed to accommodate a user's front foot, or otherwise configured so that all or a portion of the center protrusion 802 can be positioned beneath a user's front foot.

In any of the embodiments of the snowboards disclosed herein, two or more parallel oriented longitudinal protrusions 802 can be positioned symmetrically offset from the lateral center C1 of the snowboard 800. The longitudinal protrusion or protrusions 802 can each define a width of approximately 0.75 in, or from approximately 0.375 in or less to approximately 1.125 in or more. Additionally, in any of the embodiments of the snowboards disclosed herein, the profile of the leading longitudinal protrusions can be different than the profile of the rearward portion of the longitudinal protrusions.

Some embodiments of the snowboard 800 can be configured such that the forward portion 802A of the protrusion 802 can be positioned closer to the nose 812 of the snowboard 800 than the forward portion 804A of the rearward protrusion 804 and the forward portion 806A of the rearward protrusion 806. In any of the embodiments of the snowboards disclosed herein, the center protrusion 802 can be positioned such that all or a portion of the center protrusion 802 is positioned in a forward half of the snowboard. Additionally, in any of the embodiments of the snowboards disclosed herein, the center protrusion 802 can be positioned such that all or a portion of the center protrusion 802 is positioned below the threaded inserts 830 designed to accommodate a user's front foot, such that all or a portion of the center protrusion 802 can be positioned beneath a user's front foot.

As illustrated, the side protrusions 804, 806 can be symmetrically positioned so as to be offset from the longitudinal centerline C1. In some embodiments, the side protrusions 804, 806 can be sized and positioned such that the leading edges 804A, 806A of the protrusions 804, 806 are positioned in the forward half of the snowboard 800. Without limitation, the side protrusions 804, 806 can be positioned such that the leading edges 804A, 806A of the protrusions 804, 806 are positioned rearward of the leading edge 802A of the centermost protrusion 802.

In some embodiments, the side protrusions 804, 806 can be sized and positioned such that the rearward edges 804B, 806B of the protrusions 804, 806 are positioned adjacent to at least some of the inserts 830 at the fore portion of the snowboard, such that a user's front foot can be positioned over the rearward portions 804B, 806B of the protrusions 804, 806. In some embodiments, as in the illustrated embodiment, the side protrusions 804, 806 can be sized and positioned such that the rearward edges 804B, 806B of the protrusions 804, 806 are positioned rearward of the rearward edge 802B of the centermost protrusion 802

In some embodiments, the protrusions 802, 804, 806 can be straight. In some embodiments, as in the illustrated embodiment, at least a portion of the side protrusions 804, 806 can be curved, angled, or otherwise nonlinear. For example, in some embodiments, each of the side protrusions 804, 806 can be curved so as to match the approximate curvature of the edges 820, 822 of the snowboard 800. In some embodiments, a forward portion of each of the side protrusions 804, 806 can be curved so as to match the approximate curvature of the edges 820, 822 of the snowboard 800, while a rearward portion of each of the side protrusions 804, 806 can be approximately linear. Curving the protrusions 804, 806 can improve the directional stability of the snowboard 800 and can help a user initiate a turn from a straight path.

The rearmost side protrusions 854, 856 can be positioned or formed on the rearward half of the snowboard 800, and can extend toward the tail portion 814 of the snowboard. In some embodiments, as in the illustrated embodiment, the protrusions 854, 856 can be sized and positioned such that the rearmost portions 854B, 856B of the side protrusions 854, 856 are positioned approximately adjacent to the rearmost portion of the threaded inserts 832 that are configured to support a user's rear foot, such that the rearmost portions 854B, 856B of the side protrusions 854, 856 can be positioned approximately under at least a portion of a user's rear foot. In some embodiments, where the side protrusions 854, 856 define approximately uniform cross-sections along the length thereof, terminating the side protrusions 854, 856 under a user's rear foot can result in a significant length of the rear portion of the snowboard that is free of the protrusions so as to increase a user's ability to slide or laterally move the tail portion 814 of the snowboard when needed. In some embodiments, the rearmost side protrusions 854, 856 can extend to the rear of the rearward inserts 832.

The rearmost side protrusions 854, 856 can extend forward of the rearmost inserts 832 or foot position toward the front half of the snowboard 800. In some embodiments, the rearmost side protrusions 854, 856 can be positioned entirely in the rearward half of the snowboard 800. In some embodiments, the rearmost side protrusions 854, 856 can extend into the front half of the snowboard 800.

Additionally, in some embodiments, any of the protrusions 802, 804, 806, 854, 856 can be discontinuous or can define cutouts along the length thereof. The discontinuities or the cutouts can be approximately flat and coplanar with the remainder of the bottom surface 810 of the snowboard so as to permit cross-flow of snow laterally across the bottom surface 810 of the snowboard 810. Additionally, in some embodiments, the discontinuities or cutouts along the length of any of the protrusions 802, 804, 806, 854, 856 can result in additional forward surfaces 802A, 804A, 806A, 854A, 856A that can engage the snow surface and impede the forward motion of the snowboard, so as to provide additional longitudinal stability to the snowboard. In some embodiments, the length of the cutouts can be approximately 1.5 in, or from approximately 1 in or less to approximately 3 in or more, or from approximately 1 in or less to approximately 2 in or more. The forward edges 804A can have a shape that is similar to any of the other forward edge shapes disclosed herein, including spherical, triangular, beveled, bullnose, or other suitable shapes. In some embodiments, the forward edge 802A, 804A, 806A, 854A, 856A of any of the protrusions 802, 804, 806, 854, 856 can vary along the length thereof.

The lead protrusions 802, 804, 806 can be configured so as to attenuate or damp the forward or lateral movement of the snowboard 800, particularly when a user presses down with his or her front foot on the forward portion of the snowboard 800 so as to exert a greater force or pressure on the protrusions 802, 804, 806. Because the protrusions 802, 804, 806 can be positioned such that all or a portion of the protrusions 802, 804, 806 are in the forward portion of the snowboard 800, the effect of the protrusions 802, 804, 806 can be increased and decreased by a user by altering the amount of weight or force that is exerted by a user's front foot and, hence, on the fore portion of the snowboard 800. Therefore, in some embodiments, the user can increase the damping effect that the protrusions 802, 804, 806 can exert on the lateral and/or longitudinal movement of the snowboard by varying the amount of weight that is exerted on the user's front foot. Additionally, because the protrusions 802, 804, 806 can be positioned closer to the nose portion 812 of the snowboard 800, the protrusions 802, 804, 806 can engage the snow surface at an advanced position as compared to the rearmost protrusions 854, 856 so as to help engage the snow surface at an earlier point on the snowboard 800 as compared to the rearmost protrusions 854, 856 and thus cause an earlier or more forward portion of the snowboard 800 to initiate a turn.

In some embodiments, the lead protrusion 802 can be approximately straight (as illustrated) and can have a generally uniform cross-sections along the length thereof. In some embodiments, as illustrated, the side protrusions 804, 806 can have a curved surface in a widthwise direction (i.e., along the length thereof) that can approximately match the curvature of the side edges 820, 822. The side protrusions 854, 856 can be generally straight (as illustrated), or can be curved. In some embodiments, the side protrusions 854, 856 can be curved so as to match the curvature of the side edges 820, 822 of the snowboard.

Additionally, the leading edges 802A, 804A, 806A of the protrusions 802, 804, 806 can be spherical, triangular, beveled, curved, tapered, rounded, or similarly shaped or configured. In some embodiments, the leading edges 802A, 804A, 806A, 854, 856A of the protrusions 802, 804, 806, 854, 856 can have a generally flat angled surface. In some embodiments, the leading edges 802A, 804A, 806A, 854, 856A of the protrusions 802, 804, 806, 854, 856 can each have a spherical shape. The rearward edges or portions 802B, 804B, 806B, 854B, 856B of the protrusions 802, 804, 806, 854, 856 can be similarly shaped.

In any of the embodiments of the boards disclosed herein, the board can have one or more depressions formed in the base of the board. For example, in some embodiments, the depressions can be formed in at least the petex or base layer of the board. In some embodiments of any of the boards disclosed herein, a portion of the depressions can be formed into the core of the snowboard. In some embodiments, the depressions can have the same or similar number, length, cross-sectional size, shape, and/or position of any protrusion or protrusions disclosed herein.

For example, some embodiments of the board disclosed herein can have generally linear or straight shaped depressions 902, 904, 906, as illustrated in FIGS. 24A-24D formed in the bottom, snow facing surface of the board. The depressions 902, 904, 906 or any other embodiments of depressions disclosed herein can have the same or similar width profile, length, or position as compared to any of the embodiments of the protrusions disclosed herein.

Figure 24:
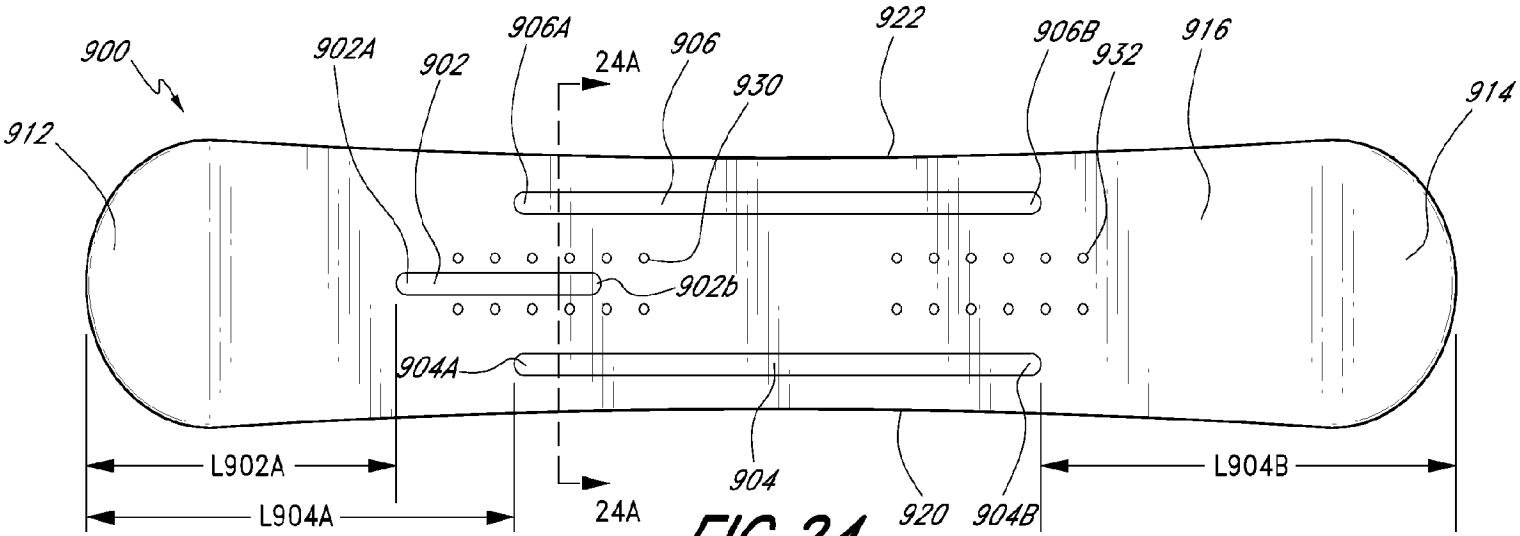
FIG. 24 is a bottom view of another embodiment of a snowboard showing generally lengthwise depressions formed in a bottom surface of the snowboard.
Figure 24C:
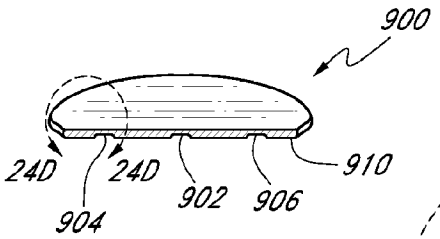
FIG. 24C is a section view of the embodiment of the snowboard shown in FIG. 24 taken through line 24C-24C in FIG. 24.
Figure 24D:
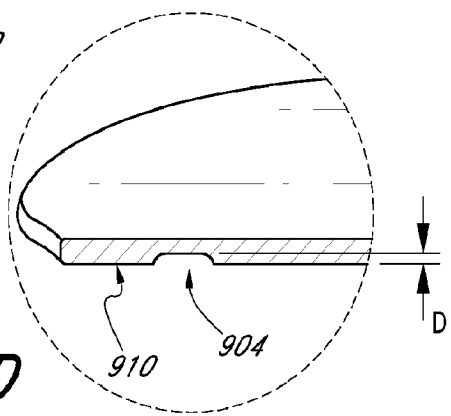
FIG. 24D is an enlargement of a portion of the section view shown in FIG. 24C, defined by curve 24D-24D in FIG. 24C.
Figure 24A:
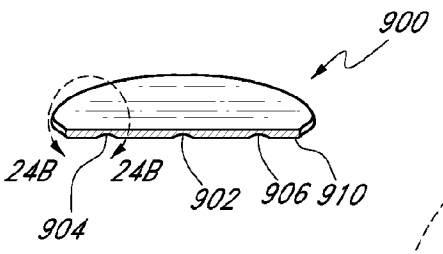
FIG. 24A is a section view of the embodiment of the snowboard shown in FIG. 24 taken through line 24A-24A in FIG. 24.
Figure 24B:
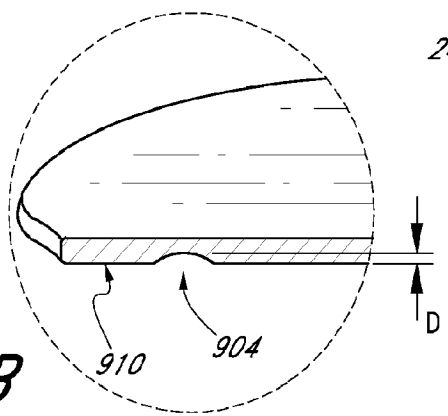
FIG. 24B is an enlargement of a portion of the section view shown in FIG. 24A, defined by curve 24B-24B in FIG. 24A.

With reference to FIGS. 24, 24A, 24B, in some embodiments, the leading or center depression 902 can be positioned in the lateral center of the snowboard 900, and can be positioned such that the forward portion 902A of the depression 902 is closer to the nose 992 of the snowboard 900 than the forward portions 904A, 906A of the side depressions 904, 906. The center depression 902 can be positioned such that all or a portion of the center depression 902 is positioned in a forward half of the snowboard. Additionally, in any of the embodiments of the snowboards disclosed herein, the center depression 902 can be positioned such that all or a portion of the center depression 902 is positioned below or adjacent to the threaded inserts 930 designed to accommodate a user's front foot, or otherwise configured so that all or a portion of the center depression 902 is positioned beneath a user's front foot.

In this configuration, for turning the snowboard 900, the user or rider may exert more weight over his front foot, simultaneously relieving pressure from the back foot and, hence, reducing the effect of the rearward depressions 904, 906. With rider weight concentrated on the front of the snowboard 900, the effectiveness of the center depression 902 and, in some embodiments, the forward portion of the side depressions 904, 906 if positioned far enough forward, can be increased so as to improve the user's ability to initiate a turn.

In some embodiments (not illustrated), two or more parallel oriented longitudinal depressions 902 can be positioned symmetrically offset from the lateral center of the snowboard 900. The longitudinal depression or depressions 902 can each define a width of approximately 0.75 in, or from approximately 0.375 in or less to approximately 1.25 in or more. Additionally, in any of the embodiments of the snowboards disclosed herein, the profile of the leading longitudinal depression(s) can be different than the profile of the rearward portion of the longitudinal depressions.

The lead depression 902 can be configured so as to attenuate or damp the lateral movement of the snowboard 900 or, to some degree, the forward movement of the snowboard 900, particularly when a user presses down with his or her front foot on the forward portion of the snowboard 900 so as to exert a greater force on the center depression 902. Because the center depression 902 can be positioned such that all or a portion of the center depression 902 is in the forward portion of the snowboard 900 (i.e., the forward half of the snowboard), the effect of the center depression 902 can be increased and decreased by a user by altering the amount of weight or force that is exerted by a user's front foot on the fore portion of the snowboard 900 and, hence, on the center depression 902. Additionally, because the lead depression 902 can be positioned closer to the nose portion 912 of the snowboard 900, the lead depression 902 can engage the snow surface at an advanced or earlier time or position as compared to the side depressions 904, 906, so as to help engage the snow surface at an earlier point on the snowboard 900 as compared to the side depressions 904, 906 and thus cause an earlier or more forward portion of the snowboard 900 to initiate a turn.

As illustrated, the side depressions 904, 906 can be symmetrically positioned so as to be offset from the longitudinal centerline. In some embodiments, the side depressions 904, 906 can be sized and positioned such that the leading edges 904A, 906A of the depressions 904, 906 are positioned in the forward half of the snowboard 900. In some embodiments, the side depressions 904, 906 can be sized and positioned such that the leading edges 904A, 906A of the depressions 904, 906 overlap or extended forward of the rearward edge or edges 902B of the center depression 902. However, in some embodiments, the side depressions 904, 906 can be sized and positioned such that the leading edges 904A, 906A of the depressions 904, 906 are spaced apart from the rearward edge or edges 902B of the center depression or depressions 902 so that a significant space or cross-flow channel is created between the center depression or depressions and the side depressions 904, 906.

In some embodiments, the side depressions 904, 906 can be sized and positioned such that the leading edges 904A, 906A of the depressions 904, 906 are positioned adjacent to at least some of the inserts 930 at the fore portion of the snowboard, such that a user's front foot can be positioned over the fore portions 904A, 906A of the depressions 904, 906. The side depressions 904, 906 can extend toward the tail portion 914 of the snowboard. In some embodiments, as in the illustrated embodiment, the depressions 904, 906 can be sized and positioned such that the rearmost portions 904B, 906B of the side depressions 904, 906 are positioned approximately adjacent to the threaded inserts 932 that are configured to support a user's rear foot, such that the rearmost portions 904B, 906B of the side depressions 904, 906 can be positioned approximately under at least a portion of a user's rear foot. In some embodiments, where the side depressions 904, 906 define approximately uniform cross-sections along the length thereof, terminating the side depressions 904, 906 under a user's rear foot can result in a significant length of the rear portion of the snowboard that is free of the depressions so as to increase a user's ability to slide or laterally move the tail portion 914 of the snowboard when needed.

As illustrated, the depressions 902, 904, 906 can be straight. In some embodiments of the depressions 904, 906 or any other depressions disclosed herein, at least a portion of the depressions can be curved, angled, or otherwise nonlinear. For example, each of the side depressions 904, 906 can be curved so as to match the approximate curvature of the edges 920, 922 of the snowboard 900. In some embodiments, a forward portion of each of the side depressions 904, 906 can be curved so as to match the approximate curvature of the edges 920, 922 of the snowboard 900, while a rearward portion of each of the side depressions 904, 906 can be approximately linear. Curving the depressions 904, 906 can improve the directional stability of the snowboard 900 and can help a user initiate a turn from a straight path.

In some embodiments, as illustrated in FIGS. 24A, 24B, any of the depressions 902, 904, 906 can have a generally arcuately shaped cross-sectional profile. Alternatively, one or more of the depressions 902, 904, 906 can have a generally flat bottom surface, as illustrated in FIGS. 24C, 24D, with perpendicular or angled side surfaces. In some embodiments, the depth D of the depressions can be approximately 0.125 in. In some embodiments, the depth D of one or more of the longitudinal protrusions can be from approximately 0.075 in or less to approximately 0.375 in or more, or from approximately 0.10 in to approximately 0.250 in, or from approximately 0.10 in to approximately 0.15 in or more.

Figures 25, 25A, 25B, 25C, 25D:
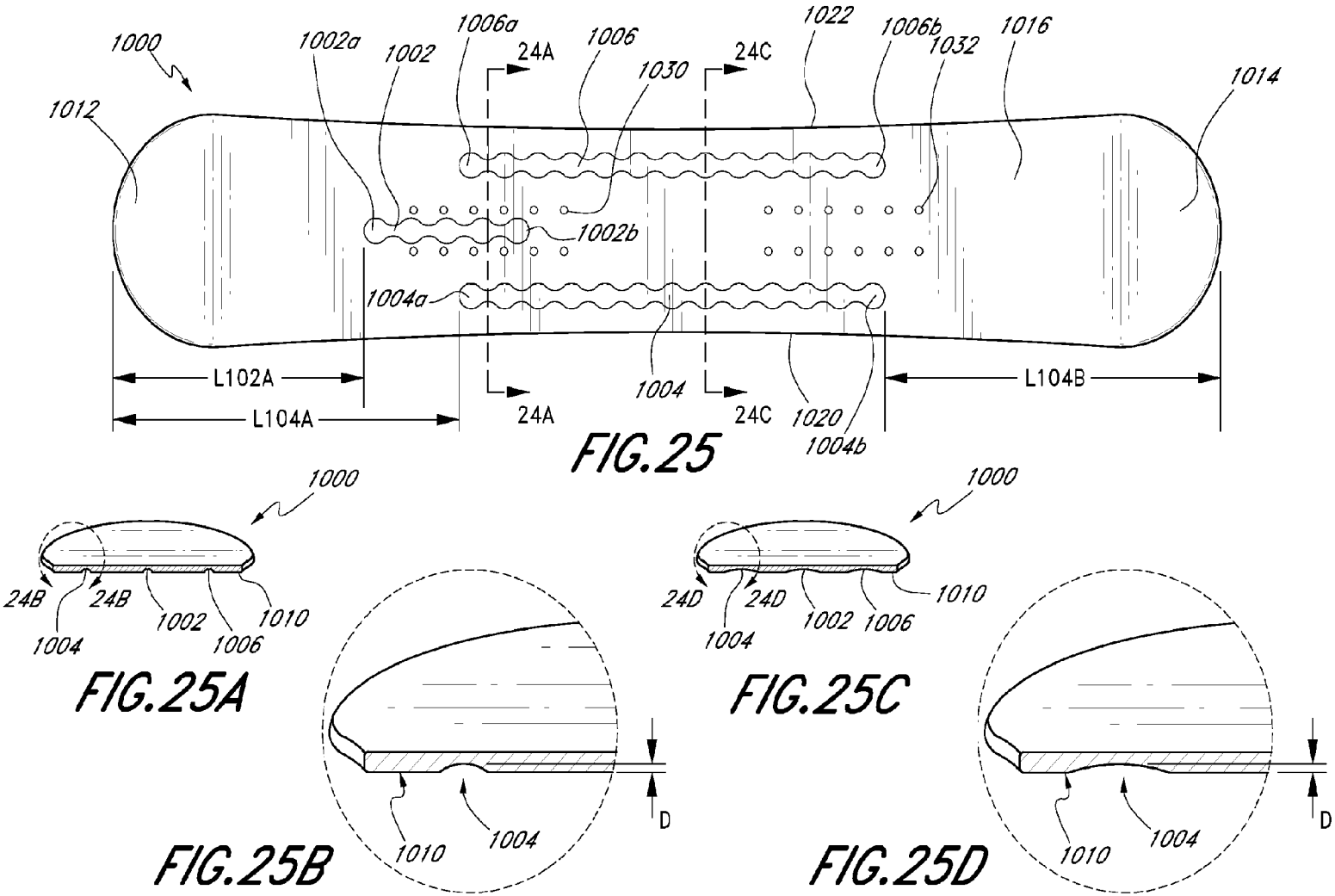
FIG. 25 is a bottom view of another embodiment of a snowboard showing generally lengthwise depressions formed in a bottom surface of the snowboard.
FIG. 25A is a section view of the embodiment of the snowboard shown in FIG. 25 taken through line 25A-25A in FIG. 25.
FIG. 25B is an enlargement of a portion of the section view shown in FIG. 25A, defined by curve 25B-25B in FIG. 25A.
FIG. 25C is a section view of the embodiment of the snowboard shown in FIG. 25 taken through line 25C-25C in FIG. 25.
FIG. 25D is an enlargement of a portion of the section view shown in FIG. 25C, defined by curve 25D-25D in FIG. 25C.

FIGS. 25-25D are illustrations of additional embodiments of a board 1000 having depressions 1002, 1004, and 1006. In some embodiments, the depressions 1002, 1004, and 1006 can have the same or similar number, length, cross-sectional size, shape, and/or position of any protrusion or protrusions disclosed herein, or any other depressions disclosed herein. With reference to FIGS. 25-25D, the depressions 1002, 1004, and 1006 can be configured to have a varying width profile along the length of one or more of the depressions 1002, 1004, 1006. As such, the depressions 1002, 1004, and 1006 can have an undulating or scalloped width such that some portions of the depressions 1002, 1004, and 1006 have a narrower width than other, adjacent portions of the depressions 1002, 1004, and 1006.

For example, FIG. 25A is a section view through the embodiment of the board 1000 illustrated in FIG. 25. As can be seen in FIGS. 25A, 25B, at least one portion of the depressions 1002, 1004, 1006 can be narrower than other portions of the depressions 1002, 1004, and 1006. In some embodiments, the wider portions of the depressions 1002, 1004, and 1006 can be from approximately 40% or less to approximately 100% or more, or from approximately 60% to approximately 80% or more wider than the narrower portions of the depressions 1002, 1004, and 1006. The depth D of the depressions can be constant or can vary along a length thereof.

In some embodiments, the depressions can have one or more dimples, bumps, or longitudinally arranged or laterally arranged ridges formed in a bottom surface of the depressions along at least a portion thereof. Additionally, a combination of longitudinally arranged and laterally arranged ridges can be formed in the depression. For example, without limitation, a depression can have longitudinally arranged ridges formed in a forward portion of the depression, and can have laterally arranged ridges formed in a middle or rearward portion of the depression. The ridges can be rounded, triangular shaped, or otherwise. The depressions can be formed by any suitable method. Without limitation, the depressions can stamped, pressed, or machined into the base surface of the board before or after the board is fully assembled. In some embodiments, the base layer of the board (which can be petex or any other suitable material) can be extruded so as to have depressions formed therein.

Additionally, some embodiments of the board can have one or more generally longitudinally arranged channels 1102, 1104, 1106 formed in a bottom surface thereof. The channels can be configured to receive one or more removable inserts, such as the embodiments of the removable inserts 1150, 1160, 1180 illustrated in FIGS. 27-29. In some embodiments, the channels can be formed in at least the petex or base layer of the board. In some embodiments of any of the boards disclosed herein, a portion of the channels can be formed into the core of the snowboard. The channels can have the same or similar number, length, cross-sectional size, and/or position of any protrusion or depression disclosed herein. In some embodiments, the board can define any combination of one or more protrusions, one or more depressions, and/or one or more channels formed therein. One or more of the channels and the inserts configured to be supported by the channel can be curved or straight.

With reference to FIGS. 27-29, the inserts that can be removably received and supported within the channels 1102, 1104, 1106 can have a positive profile (so that a portion of the positive insert extends away from a bottom surface of the board when the insert is inserted into the channel, as illustrated in FIG. 27), a negative profile (so that a portion of the negative insert defines a depression that extends into a bottom surface of the board when the insert is inserted into the channel, as illustrated in FIG. 28), a neutral profile (so that the neutral insert fills the channel to make the bottom surface of the snowboard generally smooth or flush, as illustrated in FIG. 29), or any combination thereof. This capability can allow a user to modify the base of the snowboard based on snow conditions and also to update the base of the snowboard as the skill level of the user increases. This can also make it possible for a snowboard manufacturer to sell one snowboard base with a variety of inserts to accommodate a wide range of snow conditions and skill levels. In some embodiments, the inserts can be marked with logos, brand names, resort names, locations, customizable names, or other words, symbols or other suitable illustrations.

Figures 26, 26A, 26B, 26C, 26D:
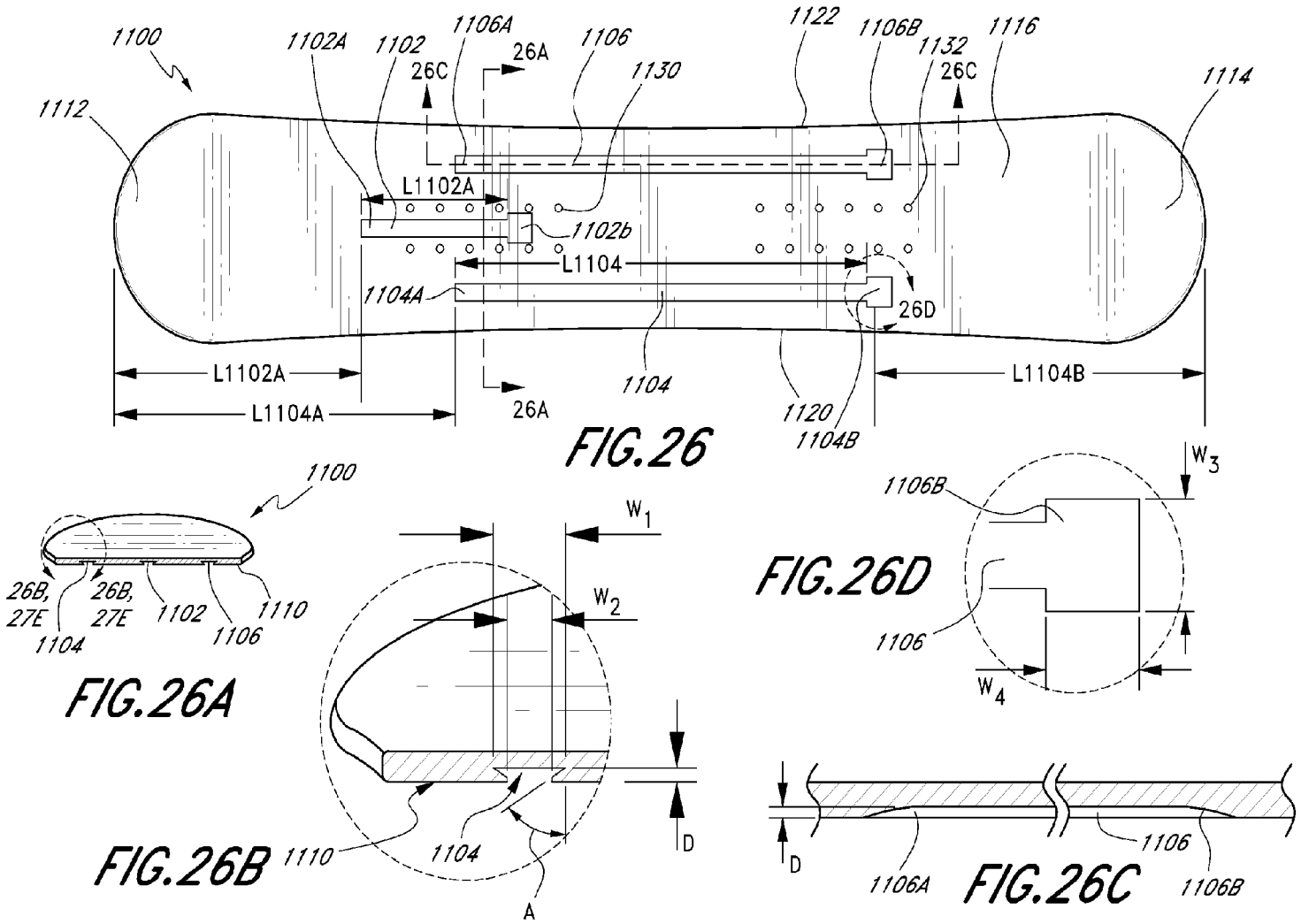
FIG. 26 is a bottom view of another embodiment of a snowboard showing generally lengthwise channels formed in a bottom surface of the snowboard.
FIG. 26A is a section view of the embodiment of the snowboard shown in FIG. 26 taken through line 26A-26A in FIG. 26.
FIG. 26B is an enlargement of a portion of the section view shown in FIG. 26A, defined by curve 26B-26B in FIG. 26A.
FIG. 26C is a section view of the embodiment of the snowboard shown in FIG. 26 taken through line 26C-26C in FIG. 26.
FIG. 26D is an enlargement of a portion of the section view shown in FIG. 26C, defined by curve 26D-26D in FIG. 26C.

With reference to FIGS. 26, for the reasons described above for the protrusions and/or depressions, the channels 1102, 1104, 1106 can be positioned such that the leading or center channel 1102 is positioned in the lateral center of the snowboard 1100, and can be positioned such that the forward portion 1102A of the channel 1102 is closer to the nose 11112 of the snowboard 1100 than the forward portions 1104A, 1106A of the side channels 1104, 1106. In any of the embodiments of the snowboards disclosed herein, the center channel 1102 can be positioned such that all or a portion of the center channel 1102 is positioned in a forward half of the snowboard. Additionally, in any of the embodiments of the snowboards disclosed herein, the center channel 1102 can be positioned such that all or a portion of the center channel 1102 is positioned below (i.e., in a direction toward the snow-facing surface of the board) or adjacent to the threaded inserts 1130 designed to accommodate a user's front foot, or otherwise configured so that all or a portion of the center channel 1102 can be positioned beneath a user's front foot.

Additionally, for the reasons described above for the protrusions and/or depressions, the side channels 1104, 1106 can be symmetrically positioned so as to be offset from the longitudinal centerline. The side channels 1104, 1106 can be sized and positioned such that the leading edges 1104A, 1106A of the channels 1104, 1106 are positioned in the forward half of the snowboard 1100. In some embodiments, the side channels 1104, 1106 can be sized and positioned such that the leading edges 1104A, 1106A of the channels 1104, 1106 overlap or extended forward of the rearward edge or edges 1102B of the center channel 1102. Alternatively, the side channels 1104, 1106 can be sized and positioned such that the leading edges 1104A, 1106A of the channels 1104, 1106 are spaced apart from the rearward edge or edges 1102B of the center channel or channels 1102 so that a significant space or cross-flow channel is created between the center channel or channels and the side channels 1104, 1106.

As illustrated in FIGS. 26A, 26B, one or more of the channels 1102, 1004, 1106 can have a tapered or dovetail type cross-sectional profile, defined by a first width W1 (at the base or innermost surface of the channel) and a second width W2 adjacent to the snow-contacting surface 1110 of the board. The width W2 can be less than the width W1 so that the inserts are supported or held within the channels. As will be discussed, the inserts can have a complementary shape. The width W1 of one or more of the channels 1102, 1104, 1106 can be approximately 0.91 in (23 mm), or from approximately 0.5 in or less to approximately 1.5 in or more, or from approximately 0.75 in to approximately 1.25 in. The width W2 of one or more of the channels 1102, 1104, 1106 can be approximately 0.79 in (20 mm), or from approximately 0.4 in or less to approximately 1.4 in or more, or from approximately 0.65 in to approximately 1.15 in. The depth D of one or more of the channels formed in a base layer (such as petex) having a thickness of approximately 0.075 in (1.9 mm) can be approximately 0.06 in (1.5 mm), or from approximately 0.04 in or less to approximately 0.15 in or more.

In some embodiments, the angle A of the tapered inner surface of the channels 1102, 1104, 1106 can be approximately 45 degrees, or from approximately 35 degrees or less to approximately 60 degrees or more, or from approximately 40 degrees to 50 degrees. As mentioned, the channels 1102, 1104, 1106 can have the same number, length, position, and other details, as appropriate, of any of the depressions or protrusions formed in the board. The length L1102, L1104, L1106 of the channels can be the same as the length L102, L104, L106 of the protrusions 102, 104, 106 described above. For example, the length of the center channel 1102 can be approximately 8 in, or from approximately 6 in or less to approximately 14 in or more. In some embodiments, the center channel 1102 can be positioned on the snowboard 110 such that the distance L1102A from the nose 1112 of the snowboard 1110 to the leading edge 1102A can be approximately 13 in, or from approximately 9 in or less to approximately 17 in or more, or from approximately 11 in or less to approximately 15 in or more. In some embodiments, one or more of the channels 1102, 1104, 1106 can extend along the entire contact length of the board.

In some embodiments, the side channels 1104, 1106 can be positioned on the snowboard 1100 such that the distance L1104B from the rear portion 1114 of the snowboard 1110 to the rear edge 1104B can be approximately 17 in, or from approximately 13 in or less to approximately 22 in or more, or from approximately 15 in or less to approximately 20 in or more. As mentioned above, terminating the side channels 1104, 1106 or any other side channels of any other snowboard disclosed herein a substantial distance from the rearward portion 1114 of the snowboard can provide an increased distance of the rearward portion of the snowboard that has unobstructed cross-flow characteristics (i.e., similar to that of a conventional base) behind the rear foot of the user to permit the user to slide to tail portion of the snowboard relative to the snow surface. In some embodiments, as in the illustrated embodiment, the side channels 1104, 1106 can be configured to terminate beneath the rear foot of the user such that a user can apply force to the side channels by exerting weight or force on the user's rear foot. In some embodiments, the side channels 1104, 1106 can be longitudinally centered along the length of the board, and can be positioned approximately 0.79 in from the side edges of the snowboard.

The channels can be formed in the base of the board (for example, without limitation, in the petex or other snow-contacting surface) during manufacture of the petex or other snow-contacting surface. Alternatively, the channels can be made by machining, stamping, pressing, or otherwise forming the channels out of the petex or other snow-contacting surface either before or after the petex or other snow-contacting surface is assembled with the other components of the snowboard. In some embodiments, the thickness of the petex or other snow-contacting surface can be increased to accommodate the channels. In some embodiments, the core of the board can be modified to accommodate the channels, a portion of which can extend into the core of the board.

FIG. 26D is an enlargement of the embodiment of the snowboard 1100 illustrated in FIG. 26, showing a non-limiting embodiment of channel 1104 having an entry/exit portion formed in the base of the board. The entry/exit portion of the channels can be configured to allow a user to slidably advance the inserts into the respective channels. The entry/exit portion can have a first width, W3, of approximately 0.79 in (2 cm) and a second width, W4, of approximately 0.79 in (2 cm).

As illustrated, the entry/exit portion for insertion of the inserts can be positioned at the rearmost portion 1104B of the channel 1104, while the foremost portion 1104A of the channel 1104 can be configured to prevent an insert from advancing forward of the foremost portion 1104A of the channel 1104. This same configuration of the entry/exit portion can also be used with the other channels 1102, 1106. In some embodiments, the entry/exit portion for insertion of the inserts can be positioned at the foremost portion of any of the channels, while the rearmost portion can be configured to prevent any further rearward movement of the inserts.

Figure 27A:
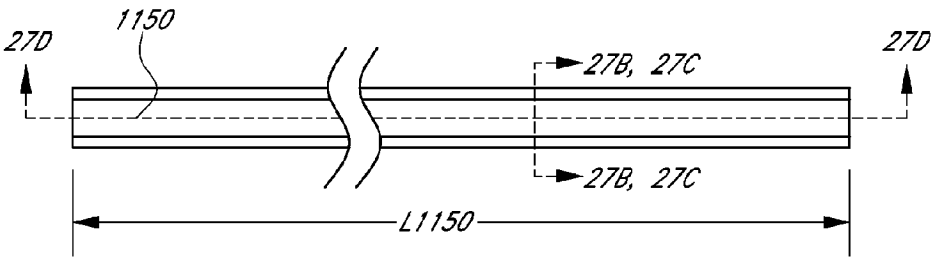
FIG. 27A is a top view of an embodiment of a positive insert configured to be supported within one or more channels formed within the board.
Figure 27B:
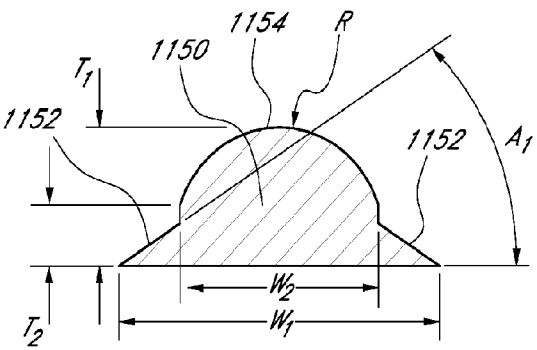
FIG. 27B is a section view of the cross-section of the embodiment of the insert illustrated in FIG. 27A, taken through line 27B-27B of FIG. 27A.
Figure 27C:
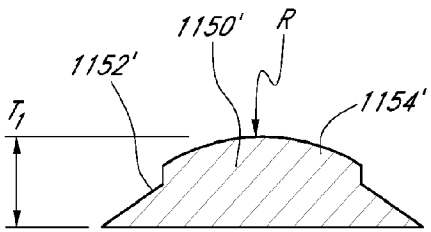
FIG. 27C is a section view of an alternative embodiment of an insert, taken through line 27C-27C of FIG. 27A.
Figure 27D:
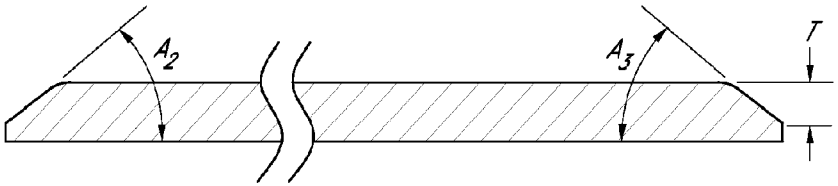
FIG. 27D is a section view of the length of the embodiment of the insert illustrated in FIG. 27A, taken through line 27C-27C of FIG. 27A.
Figure 27E:
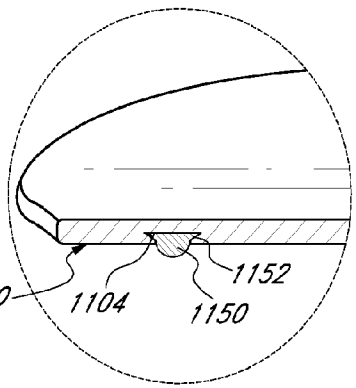
FIG. 27E is a section view of the embodiment of the positive insert illustrated in FIG. 27A assembled within a channel of a board.

With reference to FIGS. 27A-27D, a portion of the positive insert 1150 can have a size and geometry that complements the size and geometry of the channel provide a support for the insert, as is illustrated in FIG. 27E, which shows an insert assembled with a channel. For example, in some embodiments, the insert 1150 can have a first width W1 that can be approximately the same as or slightly less than the width W1 of the channel, and a second width W2 that can be approximately the same as or slightly less than the width W2 of the channel so that the insert can be tightly supported within the channel. Similarly, the angle A1 of the side portions 1152 can be approximately the same as the angle A of the channels.

The positive inserts can have an overall thickness T1 and a base portion thickness T2. The base portion thickness T2 of the insert can be approximately the same as the depth D of the channels, such that the insert projects away from the snow-contacting surface of the snowboard by a distance equal to T1-T2. In some embodiments, the insert 1150 can project away from the snow-contacting surface of the snowboard by a distance of approximately the same as with the embodiments of the projections described above. In some embodiments, the insert 1150 can be configured to project away from the snow-contacting surface of the snowboard by a distance of approximately 0.4 in, or from approximately 0.075 in or less to approximately 0.50 in or more, or from approximately 0.20 in or less to approximately 0.40 in or more.

Some embodiments of the positive inserts can have a rounded snow-contacting surface 1154, defined by radius R. Radius R can be approximately one-half of W2, as illustrated in FIG. 27B, or can be much larger than W2, as for the snow-contacting surface 1154' of the insert 1150' illustrated in FIG. 27C, which has a smaller thickness T' as compared to the insert 1150. Alternatively, the snow-contact surface 1154 of the insert can define any other suitable constant shape (as illustrated in FIG. 27D) or variable (i.e., undulating) shape, including elliptical, triangular, hexagonal, or otherwise. Additionally, the insert 1150 can have an angled leading and/or trailing edge, defined by angles A2, A3 as shown in FIG. 27D. The angles A2, A3 can be the same, and can be approximately 45 degrees, or from approximately 45 degrees to approximately 25 degrees or less to approximately 60 degrees or more.

With reference to FIGS. 28A-28D, some embodiments of the negative insert 1160 can be the same as the positive insert 1150, except that the negative inserts 1160 can define a groove or depression 1162 therein along all or a portion of the length thereof. For example, the insert 1160 can have a thickness T that is approximately equal to the depth D of the channel receiving the insert 1160. The depth D1 of the depression 1162 can be slightly less than the thickness T of the insert 1160 to maintain the strength of the insert 1160, but can be maximized so that the depression 1162 engages the snow surface as effectively as possible. In some embodiments, the depth D1 of the depression can be approximately one-half of the thickness T of the insert 1160.

Figure 28B:
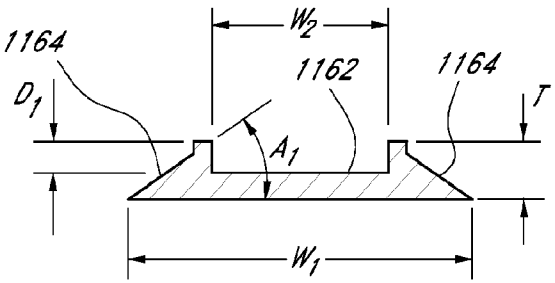
FIG. 28B is a section view of the cross-section of the embodiment of the insert illustrated in FIG. 28A, taken through line 28B-28B of FIG. 28A.
Figure 28C:
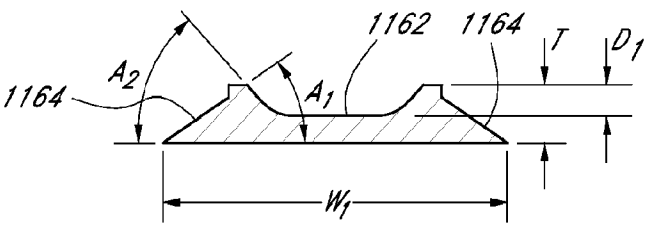
FIG. 28C is a section view of an alternative embodiment of an insert, taken through line 28C-28C of FIG. 28A.
Figure 28A:
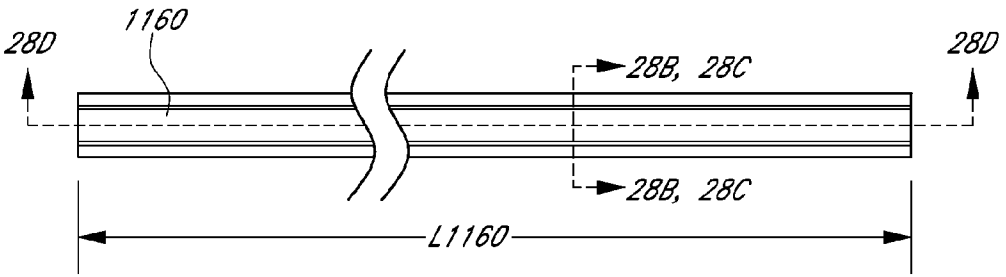
FIG. 28A is a top view of an embodiment of a positive insert configured to be supported within one or more channels formed within the board.

In some embodiments, the depth D1 of the depression 1162 can vary along the length thereof, either in a tapering (with either the front or the rear portion of the depression having the greatest depth) or in an undulating fashion. Further, without limitation, the depression 1162 can have one or more dimples, bumps, or longitudinally arranged or laterally arranged ridges formed in a bottom surface of the depression along at least a portion thereof. The ridges can be rounded, triangular shaped, or otherwise. In some embodiments, the depression 1162 can have a rectangular cross-sectional profile, as illustrated in FIG. 28B, or can have a more smoothly progressing cross-sectional profile, as illustrated in FIG. 28C. The depression 1162 illustrated in FIG. 28C can have sides angled at angle A2 (which can be approximately 45 degrees, or from approximately 30 degrees or less to approximately 60 degrees or more).

Figure 28D:
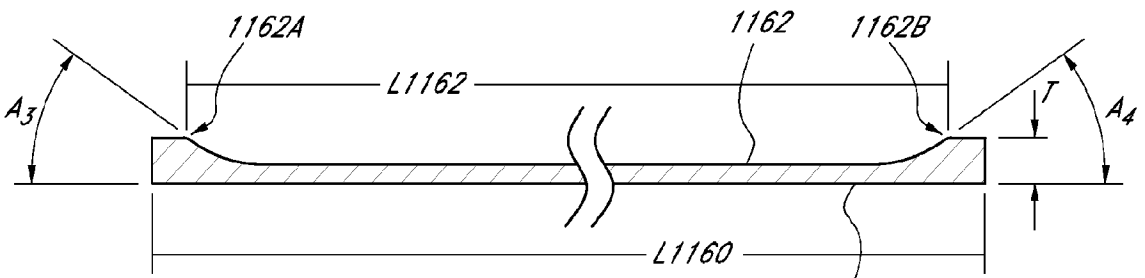
FIG. 28D is a section view of the length of the embodiment of the insert illustrated in FIG. 28A, taken through line 28C-28C of FIG. 28A.

The depression 1162 can have a length L1162 equal to the length 1160 of the insert 1160, or can have a length L1162 less than the length 1160 of the insert 1160, as illustrated in FIG. 28D. In some embodiments, the depression can extend through rearward portion of the insert 1160. The fore portion of the depression 1162 can have an entry angle A2 and/or exit angle of approximately 45 degrees, or from approximately 30 degrees or less to approximately 60 degrees or more. Additionally, in some embodiments, the fore and aft portions 1162A, 1162B of the depression 1162 of one or more of the inserts 1160 can be rounded or smoothed to smooth the transition into and out of the depression 1162. This can reduce the drag effect of the fore and aft portions 1162A, 1162B of the depression 1162 relative to the snow surface.

Figure 29A:
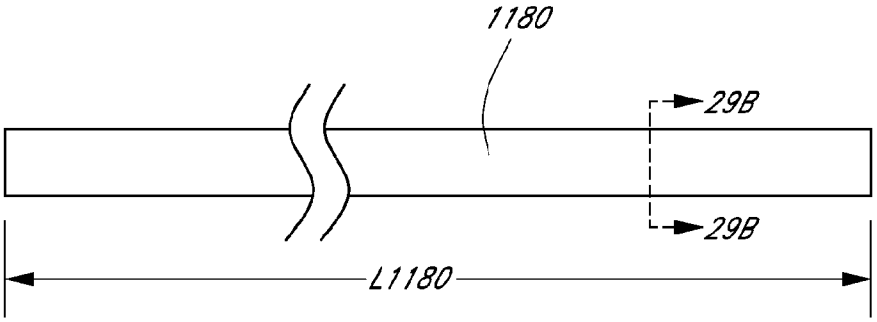
FIG. 29A is a top view of an embodiment of a positive insert configured to be supported within one or more channels formed within the board.
Figure 29B:
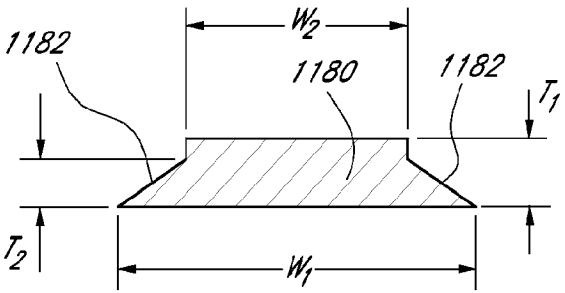
FIG. 29B is a section view of the cross-section of the embodiment of the insert illustrated in FIG. 29A, taken through line 29B-29B of FIG. 29A.

As illustrated in FIGS. 29A, 29B, some embodiments of a neutral insert 1180 can be configured to essential fill the channels formed in the base of the board so that the base of the board is approximately flush or continuous along the length and/or width thereof. As such, the neutral insert 1180 can have a thickness T1 that is approximately the same as the depth D of the channels, and a first and a second width W1, W2 that approximately match the widths of the channels.

The inserts 1150, 1160, 1180 can have any suitable length L1150, L1160, L1180, respectively, which can approximately match the length of the channel providing the support for the insert. The inserts 1150, 1160, 1180 can be made from any of a variety of materials, including, without limitation, Polyethylene, Polypropylene, UHMWPE, Mylar, Riteflex, Vandar, Hytrel, Celanex, Ultradur, Rynite, Ultramid, Grilamid, Zytel, Polypenco 101, MDS, Nylatron GS, Zytel 45 HSB, Nylon 6/6, glass reinforced Nylon, Delrin, Ultraform, Celcon, Delrin, AF Blend, ESD Materials, Ultem, Teflon, Fluoropolymers, and Paper, Linen & canvas laminated Phenolic G-7, G-9, G-10, G-11, vulcanized fiber, or any combination of the foregoing.

In this configuration, the channels 1102, 1104, 1106 can support inserts having any desired cross-sectional profile. For example, a positive insert (such as insert 1150) can be supported within the leading channel 1102, while negative inserts (such as insert 1160) or neutral inserts (1180) can be supported within the lateral channels 1104, 1106, or vice versa.

In some embodiments, one or more of the inserts 1150, 1160, 1180 can be permanently mounted to the board (after such inserts have been slidably or otherwise received within the respective channels) within the channels 1102, 1104, 1106, or can be removably mounted to the board with the channels 1102, 1104, 1106. The inserts 1150, 1160, 1180 can be mounted to the board within the channels 1102, 1104, 1106 using adhesive, double sided adhesive tape, heat activated or otherwise, snap fittings, tabs and detents, rivets, one or more screws, bolts penetrating through the thickness of the board, one or more bolts received by threaded inserts positioned within one or more the channels 1102, 1104, 1106, or by any other combination of such means or by any other suitable means. In some embodiments, one or more inserts can be fixed directly to the bottom or snow-contacting surface of the board (i.e., without being positioned within the channels) by any of the means described herein. Additionally, petex, wax, or other appropriate materials can be melted around the perimeter of the inserts after the inserts have been assembled with the channels to improve the connection between the inserts and the channels, and also to provide a water and snow resistant barrier around the perimeter of the inserts.

While the above detailed description has shown, described, and pointed out novel features as applied to various embodiments, it will be understood that various omissions, substitutions, and changes in the form and details of the device or process illustrated can be made without departing from the spirit of the disclosure. Additionally, the various features and processes described above can be used independently of one another, or can be combined in various ways. All possible combinations and subcombinations are intended to fall within the scope of this disclosure.

As will be recognized, certain embodiments described herein can be embodied within a form that does not provide all of the features and benefits set forth herein, as some features can be used or practiced separately from others. The scope of the inventions is indicated by the appended claims rather than by the foregoing description. All changes which come within the meaning and range of equivalency of the claims are to be embraced within their scope.

What is claimed is:

1. A board for riding on a snow surface, comprising:

a base comprising:

side edges, a top surface and a bottom surface;

a front end having an upwardly curved tip;

a back end having an upwardly curved tail;

a front binding attachment element positioned closer to the tip of the base than to the tail of the base; and a rear binding attachment element positioned closer to the tail of the base than to the tip of the base; and a first snow engaging element, a second snow engaging element, and a third snow engaging element each positioned on the bottom surface of the base;

wherein:

the first snow engaging element is positioned approximately along a centerline of the base and positioned such that at least a portion of the first snow engaging element is generally in the same longitudinal position as the front binding attachment element or between the front binding attachment element and the tip of the base, the first snow engaging element being positioned entirely on a forward half of the base, the forward half of the base extending from a middle of the base to the tip of the base;

the second snow engaging element is offset from the longitudinal centerline of the base and is positioned such that at least a portion of the second snow engaging element is generally in the same longitudinal position as the rear binding attachment element and at least partially on a rearward half of the base, the rearward half of the base extending from the middle of the base to the tail of the base; and the third snow engaging element is offset from the longitudinal centerline of the base and is positioned such that at least a portion of the third snow engaging element is generally in the same longitudinal position as the rear binding attachment element and at least partially on the rearward half of the base.

2. The snowboard of claim 1, wherein the first snow engaging element is positioned such that a fore portion of the first snow engaging element is closer to the tip of the base than either the second or third snow engaging elements.

3. The snowboard of claim 1, wherein each of the first, second, and third snow engaging elements have a linear shape in a lengthwise direction.

4. The snowboard of claim 1, wherein at least one of the first, second, and third snow engaging elements comprises a depression formed in the base.

5. The snowboard of claim 1, wherein at least one of the first, second, and third snow engaging elements comprises a protrusion projecting away from the base.

6. The snowboard of claim 1, wherein the second snow engaging element and the third snow engaging element are approximately symmetrically positioned about a longitudinal centerline of the base.

7. The snowboard of claim 1, wherein the profile of at least one of the first snow engaging element, second snow engaging element, and third snow engaging element defines a curved snow-contacting surface.

8. The snowboard of claim 1, wherein the at least one of the first snow engaging element, second snow engaging element, and third snow engaging element is discontinuous along the length thereof.

9. The snowboard of claim 1, wherein the second snow engaging element and the third snow engaging element are each curved in a lengthwise direction, the curvature approximately matching a curvature of the side edges of the base.

10. The snowboard of claim 1, wherein the bottom surface of the base is convex or reverse cambered.

11. A board for riding on a snow surface, comprising:

a base comprising side edges, a top surface, a bottom surface, a fore portion having an upwardly curved tip and a rear portion having an upwardly curved tail such that the fore portion and the rear portion of the base are each upwardly curved away from the bottom surface of the base, and a mid portion between the fore portion and the rear portion; and a front protrusion and a set of rearward protrusions extending from the bottom surface of the base;

wherein:

the front protrusion is positioned such that a longitudinal centerline of the front protrusion is collinear with the longitudinal centerline of the base;

the front protrusion is positioned entirely on a forward half of the base, wherein the forward half of the base extends from a middle of the base to the tip of the base; and the rearward protrusions are positioned so as to be offset from the longitudinal centerline of the base and such that at least a portion of each of the rearward protrusions is positioned on a rearward half of the base, wherein the rearward half of the base is the portion of the base that extends from the middle of the base to the tail of the base.

12. The snowboard of claim 11, wherein at least a portion of each of the rearward protrusions is positioned beneath a user's front foot during operation of the board.

13. The snowboard of claim 11, wherein the rearward protrusions are approximately symmetrically positioned about the longitudinal centerline of the base.

14. The snowboard of claim 11, wherein the profile of at least one of the front protrusion and the rearward protrusions defines a curved snow-contacting surface.

15. The snowboard of claim 11, wherein at least one of the front protrusion and the rearward protrusions defines cutouts along the length thereof configured to permit cross-flow of snow through the cutouts in a direction that is lateral to the length of the protrusion.

16. The snowboard of claim 11, wherein at least one of the front protrusion and the rearward protrusions comprises a plurality of segments, each of the segments being spaced apart from one another.

17. The snowboard of claim 11, wherein the rearward protrusions are each curved in a lengthwise direction, the curvature approximately matching a curvature of the side edges of the base.

18. The snowboard of claim 11, wherein the front protrusion and the rearward protrusions are integrally formed with the bottom surface of the base.

19. The snowboard of claim 11, wherein the front protrusion and the rearward protrusions are attached to a bottom surface of the base.

20. The snowboard of claim 11, wherein the rearward protrusions terminate under a rear binding attachment element, the rear binding attachment element positioned closer to the tail of the base than to the tip of the base, and extend aft of a front binding attachment element, the front binding attachment element positioned closer to the tip of the base than to the tail of the base.

21. The snowboard of claim 11, wherein the bottom surface of the base is convex or reverse cambered.

22. A board for riding on a snow surface, comprising:

a base comprising side edges, a top surface, a bottom surface, a forward end portion having an upwardly curved tip, and a rear end portion having an upwardly curved tail such that the forward end portion and the rear end portion of the base are each upwardly curved away from the bottom surface of the base; and a first longitudinal protrusion, a second longitudinal protrusion, and a third longitudinal protrusion extending from the bottom surface of the base;

wherein:

a fore portion of the first longitudinal protrusion is positioned closer to the forward end portion of the base than a fore portion of the second longitudinal protrusion and a fore portion of the third longitudinal protrusion, wherein the fore portion of the first, second, and third longitudinal protrusions is the portion of the first, second, and third longitudinal protrusions closest to the tip of the forward end of the base;

the first longitudinal protrusion is positioned entirely on a forward half of the base and defines a longitudinal centerline that is collinear with the longitudinal centerline of the base, the forward half of the base extending from a middle of the base to the tip of the forward end of the base;

the second and third longitudinal protrusions are positioned such that a rear portion of each the second and third longitudinal protrusions are positioned closer to the tail of the rear end portion of the base than a rear portion of the first longitudinal protrusion;

at least one of the first longitudinal protrusion, second longitudinal protrusion, and third longitudinal protrusion defines a profile that is curved in a widthwise direction.

* * * * *